US011823625B2

(12) United States Patent
Wu et al.

(10) Patent No.: US 11,823,625 B2
(45) Date of Patent: Nov. 21, 2023

(54) DISPLAY PANEL AND DISPLAY DEVICE

(71) Applicant: Xiamen Tianma Micro-Electronics Co., Ltd., Xiamen (CN)

(72) Inventors: Hao Wu, Xiamen (CN); Hao Wu, Xiamen (CN); Poping Shen, Xiamen (CN)

(73) Assignee: Xiamen Tianma Micro-Electronics Co., Ltd., Xiamen (CN)

( * ) Notice: Subject to any disclaimer, the term of this patent is extended or adjusted under 35 U.S.C. 154(b) by 0 days.

(21) Appl. No.: 17/417,759

(22) PCT Filed: Jun. 24, 2020

(86) PCT No.: PCT/CN2020/098126

§ 371 (c)(1),
(2) Date: Jul. 14, 2022

(87) PCT Pub. No.: WO2021/237854

PCT Pub. Date: Dec. 2, 2021

(65) Prior Publication Data

US 2023/0059832 A1 Feb. 23, 2023

(30) Foreign Application Priority Data

May 29, 2020 (CN) ..... 202010478419.3

(51) Int. Cl.
*G09G 3/3266* (2016.01)

(52) U.S. Cl.
CPC ... *G09G 3/3266* (2013.01); *G09G 2310/0286* (2013.01); *G09G 2310/08* (2013.01)

(58) Field of Classification Search
CPC ..... G09G 3/3266; G09G 2310/0286; G09G 2310/08; G09G 2320/0233; G09G 3/20; G11C 19/28
See application file for complete search history.

(56) References Cited

U.S. PATENT DOCUMENTS

| | | | | |
|---|---|---|---|---|
| 10,580,509 | B2 * | 3/2020 | Li | G02F 1/13454 |
| 10,984,700 | B1 * | 4/2021 | Wang | G09G 3/20 |
| 2004/0189585 | A1 * | 9/2004 | Moon | G11C 19/184 345/100 |
| 2011/0058642 | A1 * | 3/2011 | Tsai | G09G 3/3677 377/79 |

(Continued)

FOREIGN PATENT DOCUMENTS

| | | | |
|---|---|---|---|
| CN | 105118430 | A | 12/2015 |
| CN | 106406612 | A | 2/2017 |

(Continued)

*Primary Examiner* — Dmitriy Bolotin
(74) *Attorney, Agent, or Firm* — KILPATRICK TOWNSEND & STOCKTON, LLP

(57) ABSTRACT

A shift register includes n shift register units which are cascaded. Each shift register unit includes a shift module and multiple enable modules. The shift module of an i-th-level shift register unit is configured to receive and latch a shift signal output by the shift module in an (i−1)-th-level shift register unit. The multiple enable modules of the i-th-level shift register unit are electrically connected to the shift module of the i-th-level shift register unit, and each of the multiple enable modules is configured to generate a gate driving signal according to the shift signal. n and i are positive integers, 1≤i≤n.

20 Claims, 21 Drawing Sheets

(56) References Cited

U.S. PATENT DOCUMENTS

| | | | | |
|---|---|---|---|---|
| 2012/0182279 | A1* | 7/2012 | Ochiai | G09G 3/3677 345/212 |
| 2015/0077407 | A1* | 3/2015 | Kim | G09G 3/3611 345/204 |
| 2017/0092172 | A1* | 3/2017 | Wang | G09G 3/20 |
| 2019/0333433 | A1* | 10/2019 | Zhu | G09G 3/20 |
| 2019/0371247 | A1* | 12/2019 | Huang | G11C 19/287 |
| 2020/0005701 | A1* | 1/2020 | Chen | G09G 3/2092 |

FOREIGN PATENT DOCUMENTS

| | | | |
|---|---|---|---|
| CN | 106991955 | A | 7/2017 |
| CN | 109509446 | A | 3/2019 |
| CN | 110060652 | A | 7/2019 |
| CN | 111179797 | A | 5/2020 |

* cited by examiner

DISPLAY PANEL AND DISPLAY DEVICE

CROSS-REFERENCE TO RELATED APPLICATION(S)

This is a national stage application filed under 37 U.S.C. 371 based on International Patent Application No. PCT/CN2020/098126, filed Jun. 24, 2020, which claims priority to a Chinese patent application No. 202010478419.3 filed on May 29, 2020, disclosure of which is incorporated herein by reference in its entirety.

FIELD

The present disclosure relates to display techniques and, for example, to a display panel and a display device.

BACKGROUND

A display panel includes a display area and a non-display area around the display area. The display area includes multiple pixels arranged in an array. A scanning signal line and a data signal line intersect to define corresponding pixels. When the display panel displays one frame of a picture, a corresponding scanning signal is sequentially input to each scanning signal line of the display panel so that a data signal can be written into the corresponding pixels of the display area through the corresponding data signal line, and the scanning signal input to each pixel through the scanning signal line is provided by a shift register.

In the existing art, the shift register includes multiple cascaded shift register units, and each of the multiple shift register units can output a gate driving signal to the scanning signal line under the control of a shift signal output by a previous-level shift register unit, and a corresponding clock signal, so that the scanning signal line provides a scanning signal to pixels in a same row. However, with the development of display technologies, a size of the display panel gradually increases, as a large-size display panel is usually provided with more pixels, that is, the number of pixels electrically connected to a same scanning signal line increases, the number of pixels required to be driven by the gate driving signal output by one shift register unit increases, so that the display panel has a large load, and when the gate driving signal is transmitted through the scanning signal line, it is easy to generate a large delay, resulting in a difference in display brightness between the pixels close to a shift register and the pixels farther from the shift register, and affecting the display effect of the display panel.

SUMMARY

The present disclosure provides a display panel and a display device to increase the number of gate driving signals output by a shift register unit, reduce the load amount of the gate driving signals, and reduce the display difference among multiple pixels in a same row, and improving the display effect.

The embodiment of the present disclosure provides a display panel, including pixels, scanning line groups, and a shift register.

The shift register includes n shift register units which are cascaded.

Each of the n shift register units includes a shift module and enable modules.

A shift module of an i-th-level shift register unit is configured to receive and latch a shift signal output by a shift module in an (i−1)-th-level shift register unit.

Enable modules of the i-th-level shift register unit are electrically connected to the shift module of the i-th-level shift register unit, and each of the plurality of enable modules of the i-th-level shift register unit is configured to generate a gate driving signal according to the shift signal, and n and i are positive integers, and $2 \leq i \leq n$.

Each of the plurality of the scanning line groups includes scanning signal lines; scanning signal lines of one of the plurality of scanning line groups are electrically connected to enable modules of a respective one of the plurality of shift register units in the shift register, and each of the plurality of enable modules is electrically connected to at least one of the plurality of scanning signal lines.

The plurality of pixels are arranged in an array; pixels in each row of the array are included in pixel groups, and each of the plurality of pixel groups includes at least one of the plurality of pixels.

Pixels of different pixel groups in a same row are electrically connected to different scanning signal lines of a same scanning line group, and pixels of each of the pixel groups are electrically connected to a same scanning signal line.

Each of the plurality of enable modules is configured to input a gate driving signal generated by the each of the plurality of enable modules to pixels electrically connected to the at least one of the plurality of scanning signal lines through the at least one of the plurality of scanning signal lines.

The embodiment of the present disclosure also provides a display device including the above-mentioned display panel.

DETAILED DESCRIPTION

Figure 1:
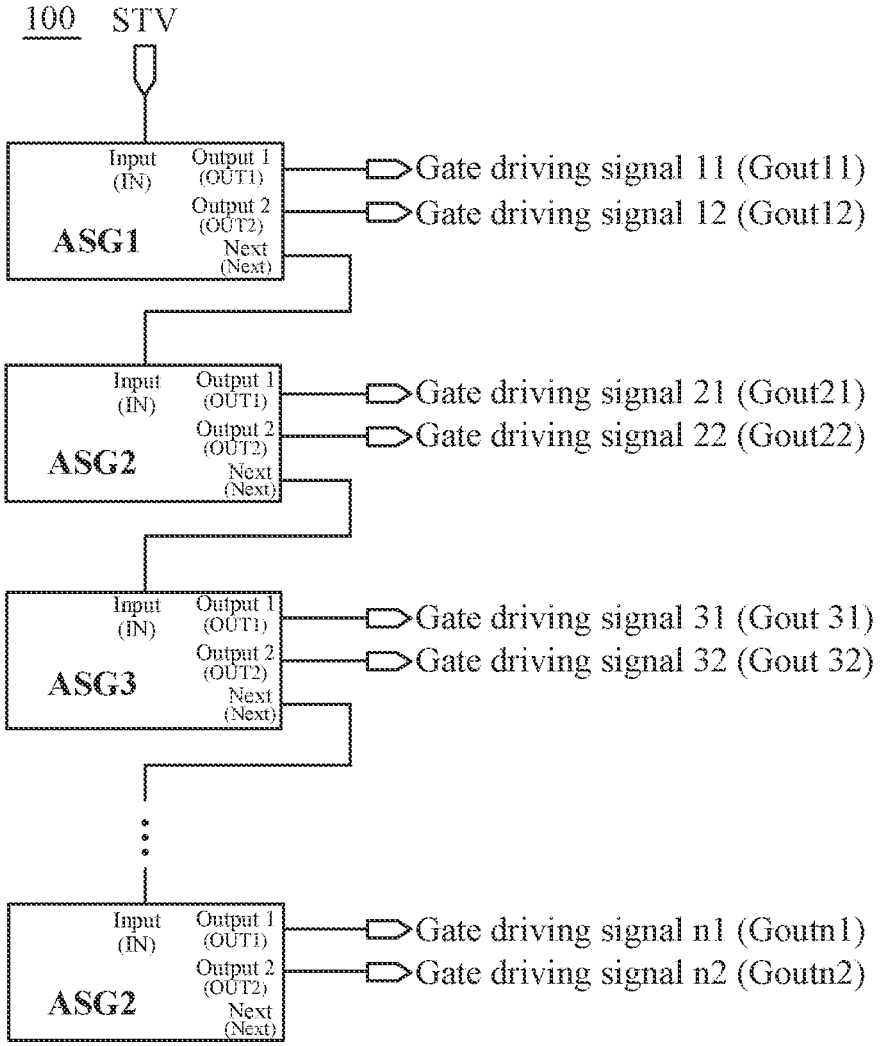
FIG. 1 is a structural diagram of a shift register provided by an embodiment of the present disclosure.

The present application is described below in conjunction with drawings and embodiments. The embodiments set forth below are intended to explain and not to limit the present application. For ease of description, only part, not all, of structures related to the present application is illustrated in the drawings.

The embodiment of the present disclosure provides a shift register. The shift register includes multiple cascaded shift register units. Each shift register unit includes a shift module and at least two enable modules. The shift module of each of the multiple cascaded shift register units receives and latches a shift signal output by the shift module in a previous-level shift register unit. The multiple enable modules of a same shift register unit are electrically connected to the shift module of the shift register unit. Each of the multiple enable modules is configured to generate a gate driving signal according to the shift signal.

By using the above embodiments, each shift register unit of the shift register is provided with one shift module and at least two enable modules, so that each shift register unit may generate at least two gate driving signals, and the multiple gate driving signals may be the same or different, and improving a driving ability of each shift register unit in the shift register. At the same time, in a case where the gate driving signals generated by multiple enable modules of a same shift register unit respectively drive different pixels in a same row, the load amount of the gate driving signals and the delay time can be reduced, and reducing the display difference among multiple pixels in the same row and further improving the display uniformity.

Solutions in embodiments of the present disclosure is described below in conjunction with drawings in embodiments of the present disclosure.

In the embodiment of the present disclosure, each shift register unit of the shift register includes a shift module and at least two enable modules, that is, each shift register unit may include two enable modules, three enable modules or multiple enable modules, which is not limited in the embodiment of the present disclosure. For ease of description, on the premise that the number of enable modules is not illustrated in the embodiment of the present disclosure, one shift register unit includes two enable modules, which is taken as an example for description.

Figure 2:
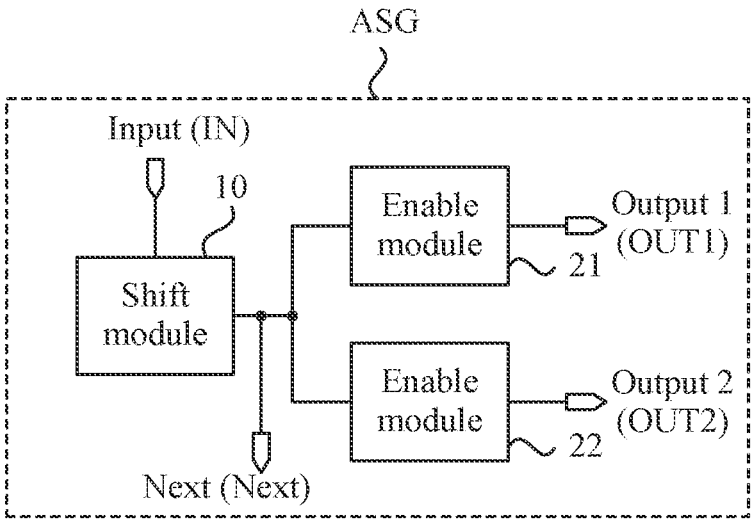
FIG. 2 is a structural diagram of a shift register unit provided by an embodiment of the present disclosure.

FIG. 1 is a structural diagram of a shift register provided by an embodiment of the present disclosure. FIG. 2 is a structural diagram of a shift register unit provided by an embodiment of the present disclosure. As shown in FIGS. 1 and 2, the shift register 100 includes multiple cascaded shift register units ASG, for example, the shift register 100 may include n shift register units ASG1 to ASGn, and the n shift register units ASG1 to ASGn are cascaded, where n is a positive integer. Each shift register unit ASG of the shift register 100 includes one shift module 10 and at least two enable modules, for example, each shift register unit ASG may include an enable module 21 and enable modules 22.

The one shift module 10 of each of then shift register units ASG1 to ASGn which are cascaded receives and latches a shift signal output by the shift module 10 in a previous-level shift register unit. In a case where a shift register unit ASG1 serves as a first-level shift register unit, a shift module 10 of the shift register unit ASG1 receives and latches a start signal STV. Correspondingly, a shift register unit ASG2 serves as a second-level shift register unit, and a shift module 10 of the shift register unit ASG2 receives and latches a shift signal output by the shift register module 10 of the shift register unit ASG1. A shift register unit ASG3 serves as a third-level shift register unit, and a shift module 10 of the shift register unit ASG3 receives and latches a shift signal output by the shift register module 10 of the shift register unit ASG2. In this way, a shift register unit ASGn serves as an n-th-level shift register unit, and a shift module 10 of the shift register unit ASGn receives and latches a shift signal output by a shift module 10 of a previous-level shift register unit of the shift register unit ASGn.

Both the enable module 21 and the enable module 22 in a same shift register unit ASG are electrically connected to the shift module 10 of this shift register unit ASG, so that the enable module 21 can output a corresponding gate driving signal according to the shift signal of the shift module 10, and the enable module 22 can output a corresponding gate driving signal according to the shift signal of the shift module 10. The gate driving signals generated by the enable module 21 and the enable module 22 may be the same or different. At this point, in the case where the shift register unit ASG1 serves as the first-level shift register unit, an enable module 21 and an enable module 22 of the shift register unit ASG1 can output gate driving signals Gout11 and Gout12 respectively according to the start signal STV. In the case where the shift register unit ASG2 serves as the second-level shift register unit, and an enable module 21 and an enable module 22 of the shift register unit ASG2 can output gate driving signals Gout21 and Gout22 respectively according to the shift signal output by the shift register unit ASG1. In the case where the shift register unit ASG3 serves as a third-level shift register unit, and an enable module 21 and an enable module 22 of the shift register unit ASG3 can output gate driving signal Gout31 and Gout32 respectively according to the shift signal output by the shift register unit ASG2. In this way, the shift register unit ASGn serves as the n-th-level shift register unit, and an enable module 21 and an enable module 22 of the shift register unit ASGn can output gate driving signal Goutn1 and Goutn2 respectively according to a shift signal output by the previous-level shift register unit.

The shift module 10 of a next-level shift register unit can control the enable module 21 and the enable module 22 of the next-level shift register unit to output the gate driving signals respectively according to the shift signal output by the shift module 10 of the previous-level shift register unit, so that one shift register unit can output two gate driving signals. When the shift register 100 is applied to the display panel, the two gate driving signals generated by the two enable modules 21 and 22 of each shift register unit ASG of the shift register 100 can be transmitted to corresponding pixels through different scanning signal lines to drive the pixels electrically connected to different scanning signal lines, and improving a driving capability of the shift register unit ASG And in a case where multiple scanning signal lines of the gate driving signals generated by multiple enable modules (21, 22) of a same shift register unit are electrically connected to different pixels in a same row respectively, a load amount on each scanning signal line is correspondingly reduced, so that the number of pixels driven by the gate driving signals generated by the multiple enable modules (21, 22) is reduced, and reducing a delay time of the gate driving signals during the transmission process, further reducing the display difference among the multiple pixels in the same row and helping to improve the display uniformity of the display panel.

Each shift register unit ASG further includes a shift signal input end IN, a shift signal output end Next and driving signal output ends (OUT1 and OUT2) in one-to-one correspondence with the enable modules (21 and 22), so that the shift module 10 of each stage shift register unit can receive and latch the shift signal output by the shift module 10 of the previous-stage shift register unit through the shift signal input end IN, and output the shift signal to the shift module 10 of the next-level shift register unit through the shift signal output end Next. The gate driving signals generated by the enable module (21, 22) of each shift register unit ASG may be output through the driving signal output ends (OUT1 and OUT2).

Each shift register unit may further include at least one clock signal input end to receive a corresponding clock control signal, and the gate driving signal generated by each enable module of the same shift register unit is also related to the clock control signal input by the clock signal input end electrically connected to the enable module.

Figure 3:
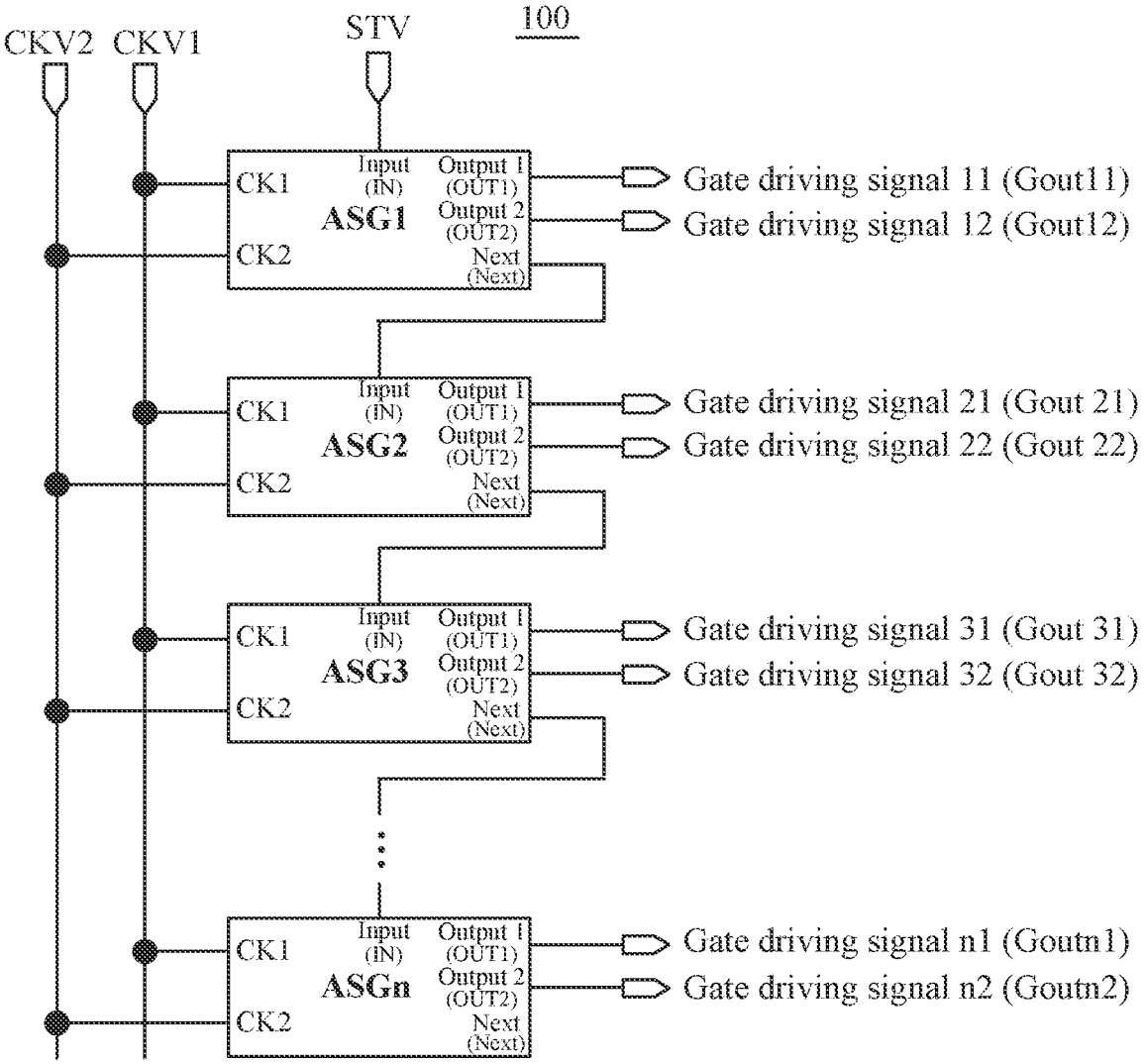
FIG. 3 is a structural diagram of another shift register provided by an embodiment of the present disclosure.
Figure 4:
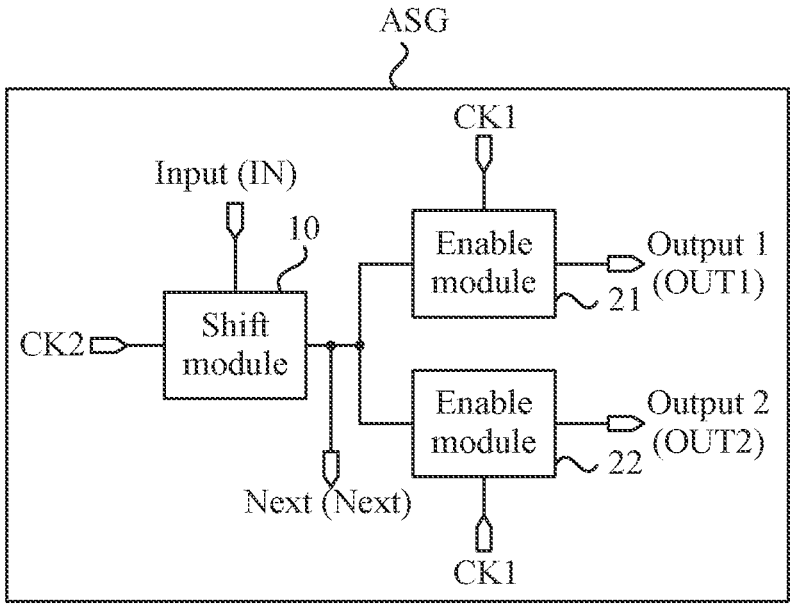
FIG. 4 is a structural diagram of another shift register unit provided by an embodiment of the present disclosure.

In one embodiment, FIG. 3 is a structural diagram of another shift register provided by an embodiment of the present disclosure. FIG. 4 is a structural diagram of another shift register unit provided by an embodiment of the present disclosure. As shown FIGS. 3 and 4, each shift register unit ASG further includes a first clock signal input end CK1. The first clock signal input end CK1 is configured to receive a first clock control signal CKV1. Multiple enable modules of the shift register unit ASG are electrically connected to the first clock signal input end CK1 of the shift register unit ASG The enable modules 21 and 22 of each shift register unit ASG are electrically connected to a same first clock signal input end CK1 in addition to the shift module 10 of the shift register unit ASG At this point, the enable modules 21 and 22 of each shift register unit ASG can generate corresponding gate driving signals according to a shift signal latched by the shift module 10 and the first clock control signal CKV1 received by the first clock signal input end CK1. In this way, when the shift register 100 is applied to the display panel, in a case where the gate driving signals generated by multiple enable modules (21 and 22) of a same shift register unit ASG can drive multiple pixels located in a same row, so that a corresponding data signal can be written into the multiple pixels located in the same row, ensuring that the display panel has a higher refresh frequency. At the same time, in a case where the gate driving signals generated by multiple enable modules (21 and 22) of the same shift register unit ASG drive different pixels located in a same row, compared with a case where a gate driving signal drives the pixels in one row, the number of pixels driven by each gate driving signal can be reduced, and reducing a delay time of the gate driving signal generated by each enable module during the transmission process, further reducing the display difference among multiple pixels in the same row, and helping to improve the display uniformity of the display panel. Alternatively, in a case where the gate driving signals generated by multiple enable modules (21 and 22) of the same shift register unit ASG are simultaneously transmitted, through one scanning signal line electrically connected to multiple pixels in the same row, to the multiple pixels in this row, a current of the gate driving signal can be increased, thus increasing the driving capability for the multiple pixels and helping to improve the display effect of the display panel.

Each shift register unit ASG of the shift register 100 may further include at least one second clock signal input end CK2, the shift module 10 of each shift register unit ASG is electrically connected to the second clock signal input end CK2 of the shift register unit, so that the shift module 10 of each shift register unit ASG can receive the second clock control signal CKV2 through the second clock signal input end CK2, and output a corresponding shift signal according to the second clock control signal CKV2 and the shift signal received by the second clock control signal CKV2.

In an embodiment of the present disclosure, to enable multiple enable modules (21, 22) of the shift register unit ASG to generate the corresponding gate driving signals according to the first clock control signal CKV1 input from the first clock signal input end CK1 and the shift signal received and latched by the shift module 10, the multiple enable modules (21, 22) of the shift register unit ASG may be composed of multiple active and/or passive devices, and the embodiment of the present disclosure does not limit a structure of the multiple enable modules of the shift register unit. The active device may be, for example, a transistor, and the passive device may be, for example, a resistor, a capacitor and the like.

Figure 5:
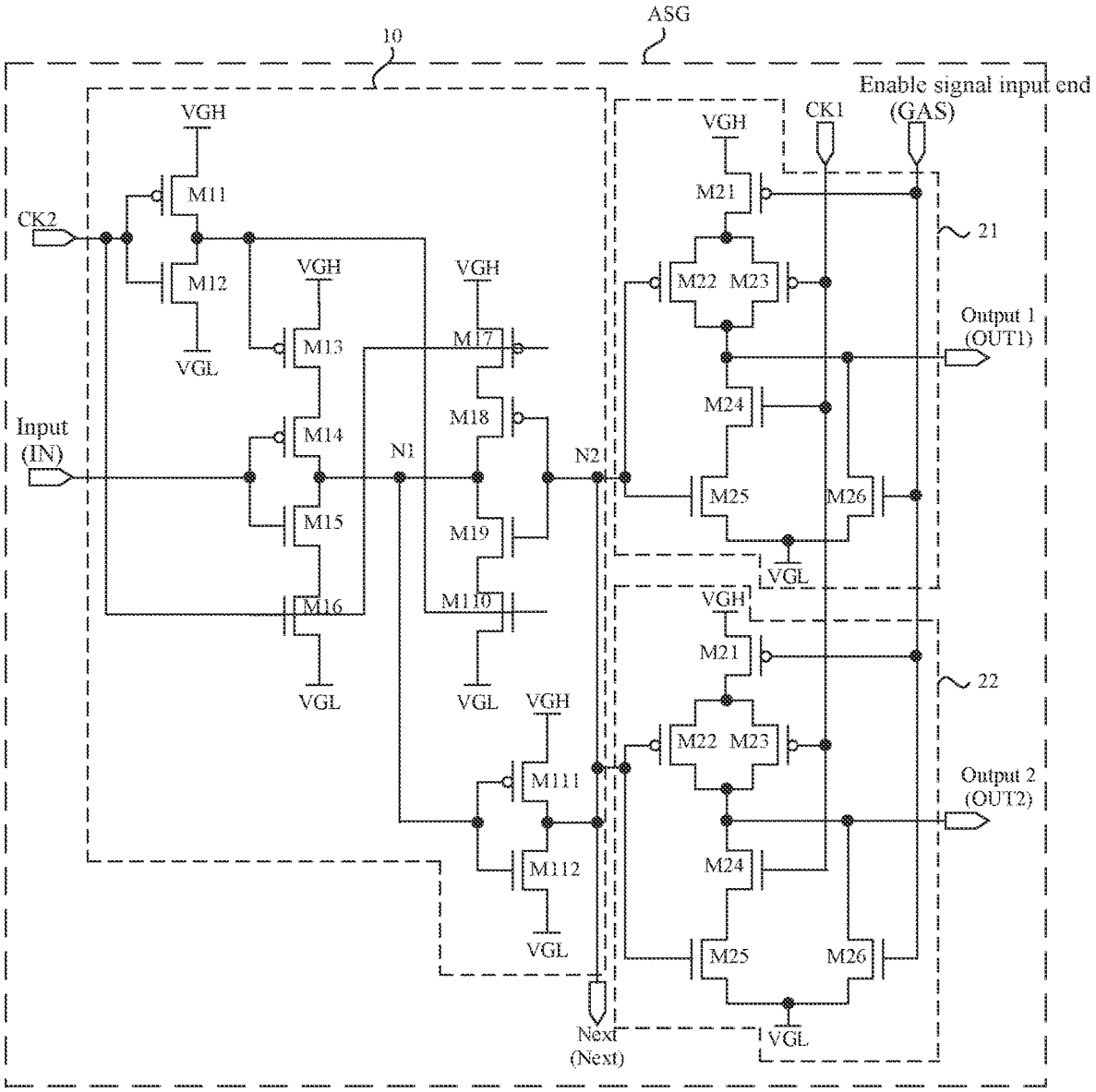
FIG. 5 is a structural diagram of a circuit of a shift register unit provided by an embodiment of the present disclosure.

Exemplarily, FIG. 5 is a structural diagram of a circuit of a shift register unit provided by the embodiment of the present disclosure. As shown in FIGS. 3 and 5, each shift register unit ASG may further include a first level signal input end VGH, a second level signal input end VGL, an enable signal input end GAS, and driving signal output ends (OUT1 and OUT2) which are in one-to-one correspondence with and electrically connected to at least two enable modules (21 and 22). The first level signal input end VGH is capable of receiving a first level signal; the second level signal input VGL is capable of receiving a second level signal; the enable signal input end GAS is capable of receiving an enable signal; the driving signal output ends (OUT1 and OUT2) are configured to output gate driving signals.

Each enable module (21 or 22) includes a first transistor M21, a second transistor M22, a third transistor M23, a fourth transistor M24, a fifth transistor M25 and a sixth transistor M26. A gate of the first transistor M21 is electrically connected to the enable signal input end GAS, a first electrode of the first transistor M21 is electrically connected to the first level signal input end VGH, and a second electrode of the first transistor M21 is electrically connected to a first electrode of the second transistor M22 and a first electrode of the third transistor M23. A gate of the second transistor M22 is electrically connected to the shift module 10, and a gate of the third transistor M23 is electrically connected to a first clock signal input end CK1. A second electrode of the second transistor M22 and a second electrode of the third transistor M23 are both electrically connected to the driving signal output end (OUT1 or OUT2). A gate of the fifth transistor M25 is electrically connected to the shift module 10, a first electrode of the fifth transistor M25 is electrically connected to the second level signal input end VGL, a second electrode of the fifth transistor M25 is electrically connected to a first electrode of the fourth transistor M24, a second electrode of the fourth transistor M24 is electrically connected to the driving signal output end (OUT1 or OUT2), and a gate of the fourth transistor M24 is electrically connected to the first clock signal input end CK1. A gate of the sixth transistor M26 is electrically connected to the enable signal input end GAS, a first electrode of the sixth transistor M26 is electrically connected to the second level signal input end VGL, and a second electrode of the sixth transistor M26 is electrically connected to the driving signal output end (OUT1 or OUT2). Channel types of the third transistor M23 and the fourth transistor M25 are different, channel types of the first transistor M21 and the sixth transistor M26 are different, and channel types of the second transistor M22 and the fifth transistor M24 are different. For example, the first transistor M21, the second transistor M22, and the third transistor M23 may all be P-type transistors, and the fourth transistor M24, the fifth transistor M25, and the sixth transistor M26 may all be N-type transistors. Alternatively, the first transistor M21, the second transistor M22, and the third transistor M23 may all be N-type transistors, and the fourth transistor M24, the fifth transistor M25, and the sixth transistor M26 may all be P-type transistors. On the premise that functions of the enable module (21 or 22) can be implemented, types of multiple transistors in the enable module are not limited in the embodiment of the present disclosure.

Using a generation principle of the gate driving signal of the enable module 21 as an example, in a case where the enable signal input end GAS receives a valid enable signal, the sixth transistor M26 is in an off state and the first transistor M21 is in an on state. At this point, in a case where the shift module 10 outputs a valid shift signal, and the first clock signal input end CK1 receives a valid first clock control signal CKV1, the fifth transistor M25 and the fourth transistor M24 are turned on, and a second level signal received by the second level signal input end VGL may be transmitted to the driving signal output end OUT1 through the turned-on fourth transistor M24 and fifth transistor M25, that is, the energy module 21 generates the gate driving signal, and the gate driving signal may be output through the driving signal output end OUT1, while in a case where the shift module 10 outputs an invalid shift signal and the first clock signal input end CK1 receives an invalid first clock control signal CKV1, neither the fifth transistor M25 nor the fourth transistor M24 can be turned on, so that the enable module 21 cannot generate the corresponding gate driving signal. In this way, under the control of the first clock control signal CKV1 received by the first clock signal input end CK1 and the shift signal output by the shift module 10, multiple enable modules of the same shift register unit ASG can generate the same gate driving signals.

Since the structure of the enable module 22 and the signal received by the enable module 22 are the same as those of the enable module 21, the principle of the enable module 22 generating the gate driving signal can refer to the above description of the enable module 21, which is not repeated here.

Referring to FIG. 5, the shift module 10 of the shift register unit ASG may also be composed of the corresponding active or passive device. For example, the shift module 10 may be composed of first inverters (M11 and M12), second inverters (M111 and M112) and eight transistors (M13, M14, M15, M16, M17, M18, M19 and M110). Channel types of the transistors M11 and M12 of the first inverter are different, and gates of the transistors M11 and M12 are input ends of the first inverter, and second electrodes of the transistors M11 and M12 are output ends of the first inverter. Channel types of the transistors M111 and M112 of the second inverter are different, and gates of the transistors M111 and M112 are input ends of the second inverter, and second electrodes of the transistors M111 and M112 are output ends of the second inverter. Channel types of the transistors M13, M14, M17, and M18 may be the same as that of the transistor M11, and channel types of the transistors M15, M16, M19, and M110 may be the same as that of the transistor M12.

The input ends of the first inverter, a gate of the transistor M16 and a gate of the transistor M17 are all electrically connected to the second clock signal input end CK2, and a gate of the transistor M13 and a gate of the transistor M110 are all electrically connected to the output ends of the first inverter. A first electrode of the transistor M11, a first electrode of the transistor M13, a first electrode of the transistor M17, and a first electrode of the transistor M111 are all electrically connected to the first level signal input end VGH, and a first electrode of the transistor M12, a first electrode of the transistor M16, a first electrode of the transistor M110, and a first electrode of the transistor M112 are all electrically connected to the second level signal input end VGL. A second electrode of the transistor M13 is electrically connected to a first electrode of the transistor M14, a second electrode of the transistor M14 and a second electrode of the transistor M15 are both electrically connected to a first node N1, and a gate of the transistor M14 and a gate of the transistor M15 are both electrically connected to a shift signal input end IN. A first electrode of the transistor M15 is electrically connected to a second electrode of the transistor M16. A second electrode of the transistor M17 is electrically connected to a first electrode of the transistor M18. A second electrode of the transistor M18 and a second electrode of the transistor M19 are electrically connected to the first node N1, and a gate of the transistor M18, a gate of the transistor M19, and the output ends of the second inverter are electrically connected to a second node N2. A first electrode of the transistor M19 is electrically connected to a second electrode of the transistor M110. The input ends of the second inverter are electrically connected to the first node N1. Further, the second node N2 is electrically connected to the enable module 21, the enable module 22, and a shift signal output end Next.

Figure 6:
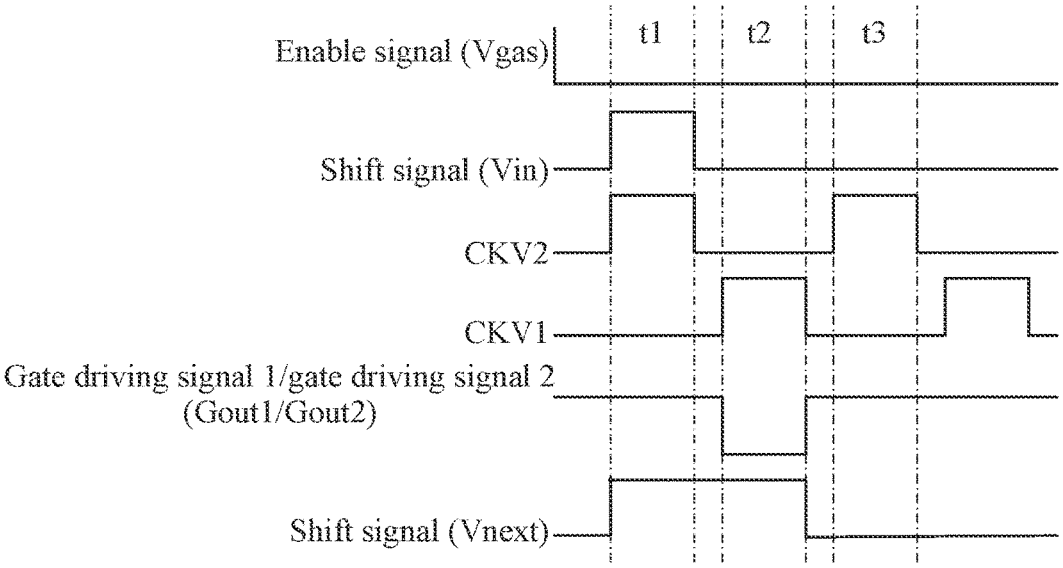
FIG. 6 is a driving timing sequence diagram of the shift register unit corresponding to FIG. 5 provided by an embodiment of the present disclosure.

Exemplarily, FIG. 6 is a driving timing sequence diagram of the shift register unit corresponding to FIG. 5 provided by an embodiment of the present disclosure. Referring to FIGS. 5 and 6, exemplarily, the transistors M11, M13, M14, M17, M18 and M111, the first transistor M21, the second transistor M22, and the third transistor M23 are all P-type transistors, and the transistors M12, M15, M16, M19, M110 and M112, and the fourth transistor M24, the fifth transistor M25 and the sixth transistor M26 are all N-type transistors.

In a first phase t1, the second clock signal input end CK2 receives a high-level second clock control signal CKV2 and controls the transistor M16 to be turned on, the shift signal input end IN receives a high-level shift signal Vin and controls the transistor M15 to be turned on, a low-level second level signal received by the second level signal input end VGL is sequentially written, through the turned-on transistors M15 and M16, to the first node N1, so that the low-level second level signal is input to the input ends of the second inverter electrically connected to the first node N1 is input, in this case, the output ends of the second inverter outputs a high-level first level signal received by the first level signal input end VGH to the second node N2, and the shift signal output end Next electrically connected to the second node N2 outputs a high-level shift signal Vnext. Accordingly, the shift module 10 outputs the high-level shift signal Vnext to the gate of the second transistor M22 of the enable module 21 and the enable module 22, and the gate of the fifth transistor M25 of the enable module 21 and the enable module 22, so that the fifth transistor M25 is turned on. In this case, since the first clock control signal CKV1 received by the first clock signal input end CK1 is a low-level signal, the third transistor M23 is in an on state, the fourth transistor M24 is in an off state, and the low-level second level signal received by the second level signal input end VGL electrically connected to the first electrode of the fifth transistor M24 cannot be output to the driving signal output ends OUT1 and OUT2. In this case, since the enable signal input end GAS receives a low-level enable signal Vgas, the sixth transistor M26 is in an off state, the first transistor M21 is in an on state, and the high-level first level signal of the first level signal input end VGH is transmitted to the driving signal output ends OUT1 and OUT2 sequentially through the turned-on first transistor M21 and the turned-on third transistor M23, that is, the driving signal output ends OUT1 and OUT2 output a high-level signal, which is not a gate driving signal.

In a second phase t2, the second clock signal input end CK2 receives a low-level second clock control signal CKV2, meanwhile, the shift signal input end IN also receives a low-level shift signal Vin, so that the first node N1 is maintained as the low-level signal in the previous level, and the signal output by the second inverter is maintained as the high-level signal, that is, the shift signal output end Next continues to output the high-level shift signal Vnext. Correspondingly, the fifth transistors M25 are turned on and the second transistors M22 are turned off in the enable module 21 and the enable module 22. At the same time, the first clock signal input end CK1 receives a high-level first clock control signal CKV1, the high-level first clock control signal CKV1 is able to control the fourth transistor M24 to be turned on, so that the low-level second level signal received by the second level signal input end VGL is transmitted to the driving signal output ends OUT1 and OUT2 sequentially through the turned-on fifth transistor M25 and the turned-on fourth transistor M24, that is, the enable module 21 and the enable module 22 simultaneously generate the gate drive signals, the driving signal output ends OUT1 and OUT2 simultaneously output the gate driving signal.

In a third phase t3, the second clock signal input end CK2 receives the high-level second clock control signal CKV2, so that transistor M12 is turned on, the low-level second level signal received by a second level signal receiving end VGL is transmitted to the gate of the transistor M13 through the turned-on transistor M12, and the shift signal input end IN continues to receive the low-level shift signal Vin, the transistor M14 is in an on state, so that the high-level first level signal received by a first level signal receiving end VGH is transmitted to the first node N1, so that a signal of the first node N1 is converted, that is, the input ends of the second inverter input the high-level signal, and the output ends of the second inverter output the low-level second level signal. Correspondingly, the shift signal Vnext output from the shift signal output end Next becomes the low-level signal, so that the second transistors M22 of the enable module 21 and the enable module 22 are turned on. The enable signal input end GAS receives the low-level enable signal Vgas, so that the first transistor M21 is turned on. In this case, the high-level first level signal of the first level signal input end VGH is transmitted to the driving signal output ends OUT1 and OUT2 sequentially through the turned-on first transistor M21 and the turned-on second transistor M22, that is, the driving signal output ends OUT1 and OUT2 no longer output the gate driving signal.

Since the N-type transistor is turned on at a high level and the P-type transistor is turned on at a low level, when the channel type of the transistor changes, the transistor can also be turned on in a corresponding phase through a corresponding timing sequence changing. In the embodiment of the present disclosure, on the premise that the shift module and the enable module of the shift register unit can implement corresponding functions, the channel types of the multiple transistors of the shift module and the enable module in the shift register unit are not limited.

Figure 7:
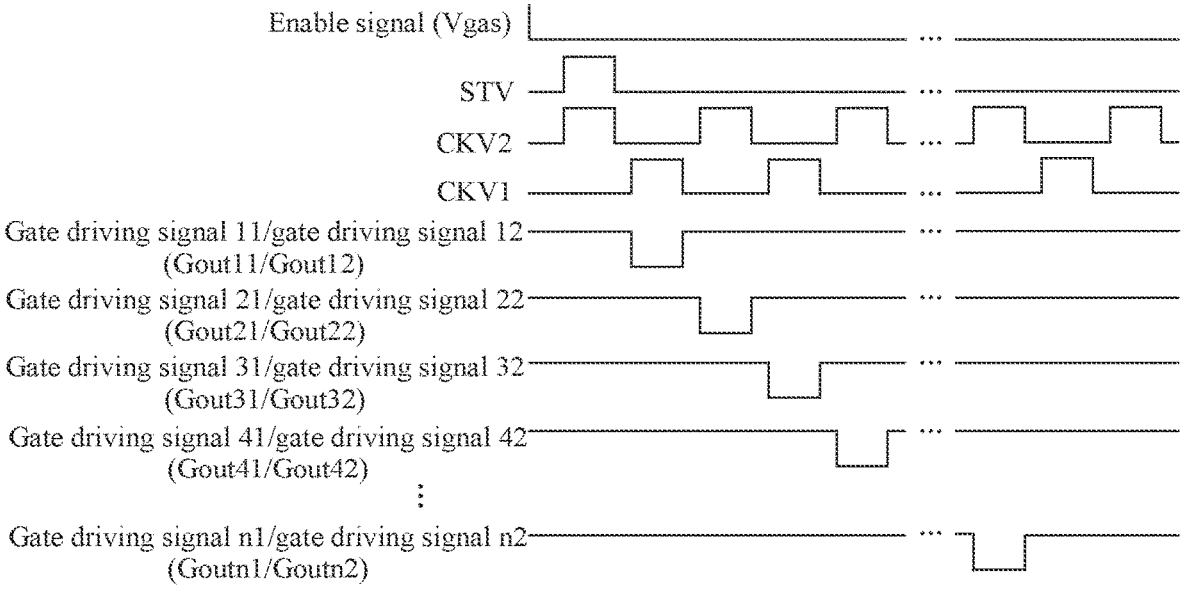
FIG. 7 is a driving timing sequence diagram of a shift register provided by an embodiment of the present disclosure.

FIG. 7 is a driving timing sequence diagram of a shift register provided by an embodiment of the present disclosure. Exemplarily, the shift module and the enable module in the shift register are the shift module and the enable module shown in FIG. 5. In conjunction with FIGS. 3, 5 and 7, in a case where the shift register unit ASG1 is a first-level shift register unit, the shift signal input end IN of the shift register unit ASG1 receives a high-level initial start signal STV and the second clock signal input end CK2 receives the high-level second clock control signal CKV2, the shift register unit ASG1 outputs the high-level shift signal to the next-level shift register unit ASG2. In the case where the shift signal input end IN of the shift register unit ASG1 receives a low-level initial start signal STV, the second clock signal input end CK2 receives the low-level second clock control signal CKV2, and the first clock signal input end CK1 receives the high-level first clock control signal CKV1, the enable module 21 and the enable module 22 of the shift register unit ASG1 output the same gate driving signals Gout11 and Gout12 respectively, while other multiple shift register units (ASG2, ASG3, . . . , and ASGn) controls the enable modules 21 and the enable modules 2 of the other multiple shift register units to output the corresponding gate driving signals according to the shift signal output by the previous-level shift register unit and received by the shift signal input end IN, the first clock control signal CKV1 received by the first clock signal input end CK1 and the second clock control signal CKV2 received by the second clock signal input end CK2 of the other multiple shift register units themselves.

Figure 8:
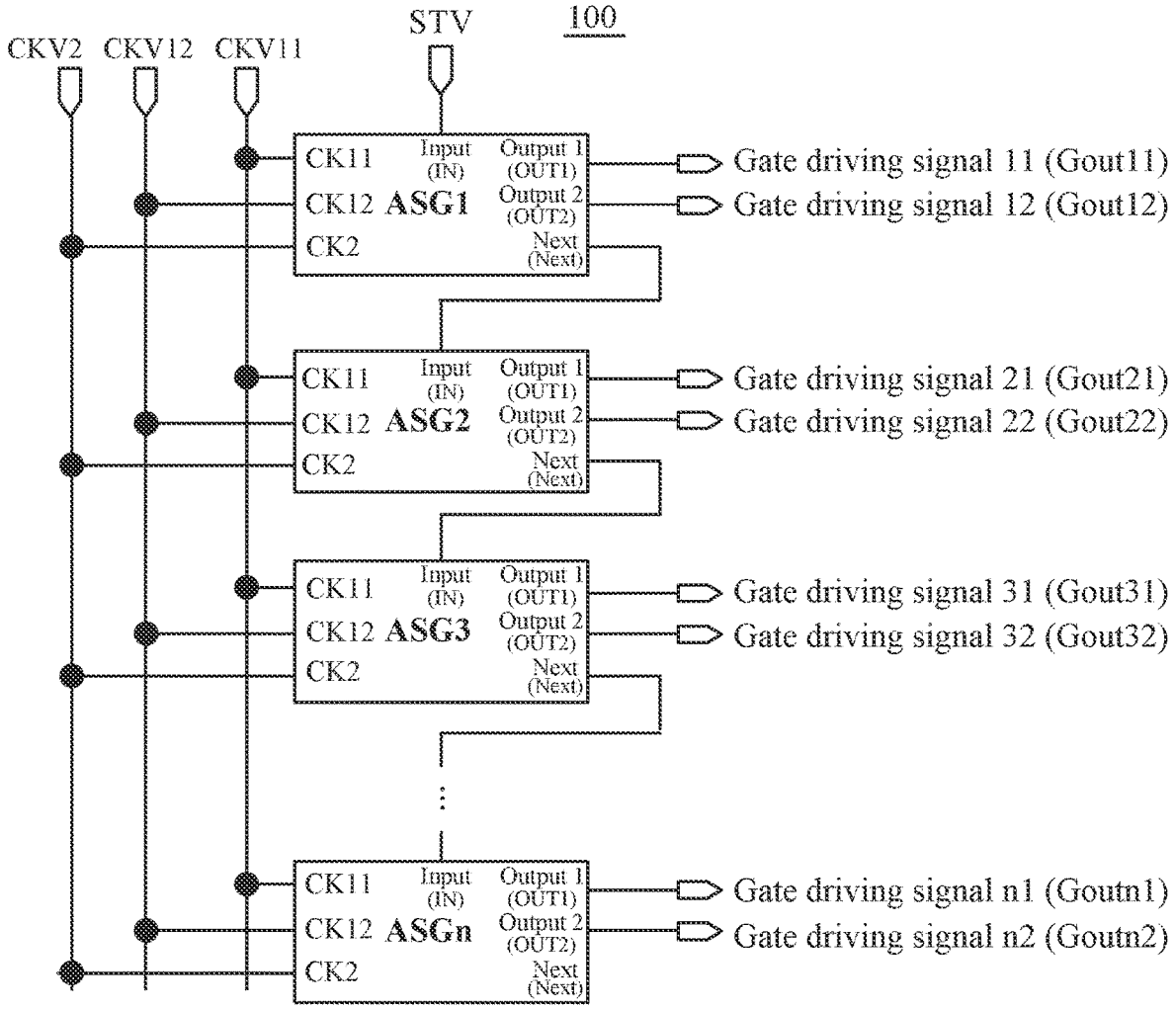
FIG. 8 is a structural diagram of another shift register provided by an embodiment of the present disclosure.
Figure 9:
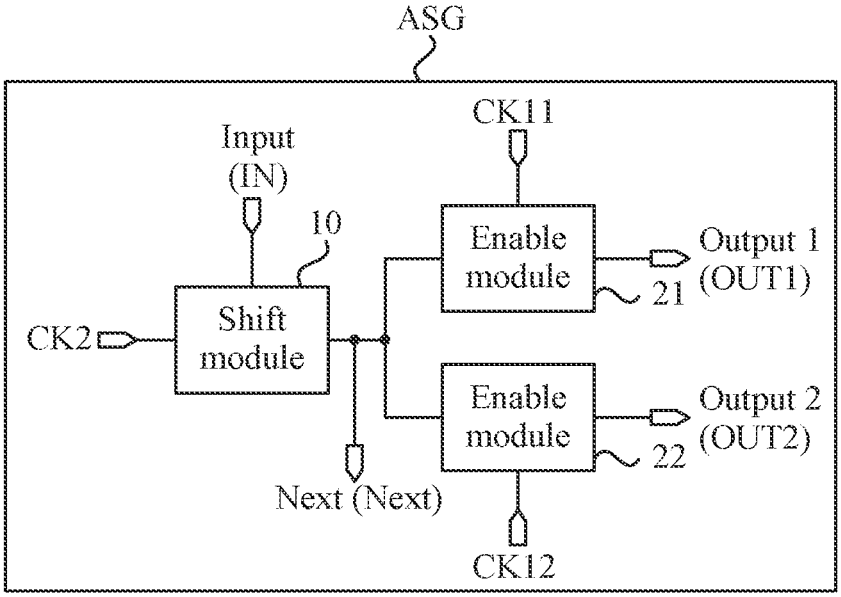
FIG. 9 is a structural diagram of another shift register unit provided by an embodiment of the present disclosure.

In one embodiment, FIG. 8 is a structural diagram of another shift register provided by an embodiment of the present disclosure. FIG. 9 is a structural diagram of another shift register unit provided by an embodiment of the present disclosure. As shown in FIGS. 8 and 9, each shift register unit ASG further includes at least two first clock signal input ends (CK11 and CK12), and the multiple first clock signal input ends (CK11, CK12) receive different first clock control signals (CKV11, CKV12). In this case, the multiple enable modules (21, 22) of the same shift register unit ASG are in one-to-one correspondence with and are electrically connected to multiple first clock signal input ends (CK11 and CK12) of the shift register unit ASG. For example, when each shift register unit ASG includes two enable modules 21 and 22, the enable module 21 is electrically connected to the first clock signal input end CK11 and to generate a gate driving signal under the control of the first clock control signal CKV11 received by the first clock signal input end CK11 and the shift signal output by the shift module 10, and the enable module 22 is electrically connected to the first clock signal input end CK12 and to generate a gate driving signal under the control of the first clock control signal CKV12 received by the first clock signal input end CK12 and the shift signal output by the shift module 10. Correspondingly, when the first clock control signals CKV11 and CKV12 are different, the gate driving signals generated by the enable module 21 and the enable module 22 of the same shift register unit ASG are different, that is, the multiple enable modules (21, 22) of the same shift register unit ASG can sequentially generate the gate driving signals according to the first clock control signals (CKV11, CKV12) received by the multiple first clock signal input ends (CK11, CK12).

Through controlling the first clock signal input end electrically connected to the multiple enable modules of the same shift register unit to receive different first clock control signals, the multiple enable modules of the same shift register unit may output different gate driving signals. In a case where the shift register is applied to the display panel, multiple enable modules of the same shift register unit may respectively provide gate driving signals for pixels in different rows and to reduce the number of shift register units configured in the shift register, and simplifying the structure of the shift register, reducing the occupied area of the shift register, and facilitating the narrow bezel of the display panel. Or in the case where the multiple enable modules of the same shift register unit respectively provide the gate driving signals for different pixels in the same row, the number of pixels driven by each gate driving signal can be reduced, and reducing the delay time of the gate driving signal during the transmission process, further reducing the display difference among the multiple pixels in the same row, and helping to improve the display uniformity of the display panel.

Figure 10:
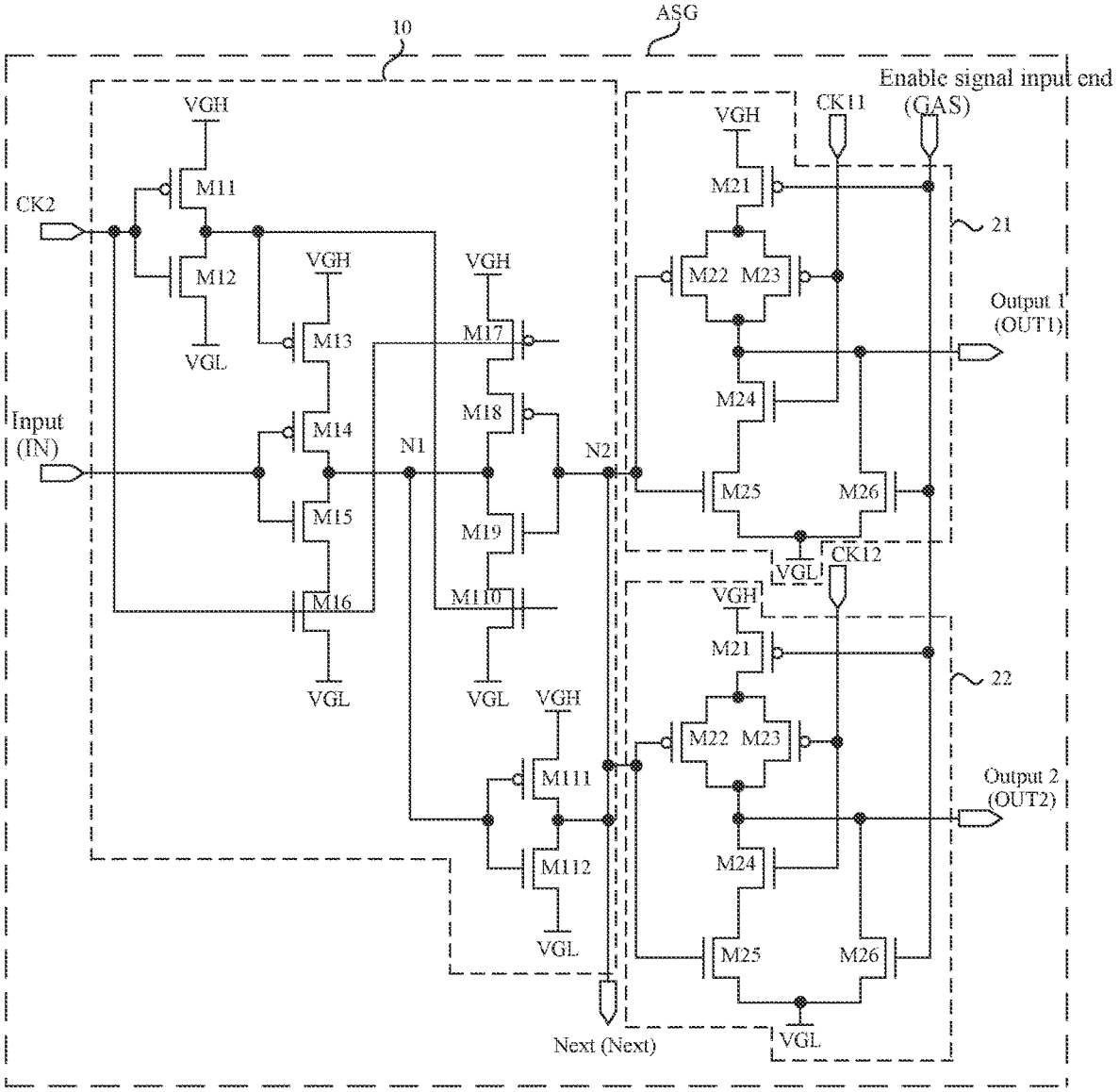
FIG. 10 is a structural diagram of a circuit of another shift register unit provided by an embodiment of the present disclosure.
Figure 11:
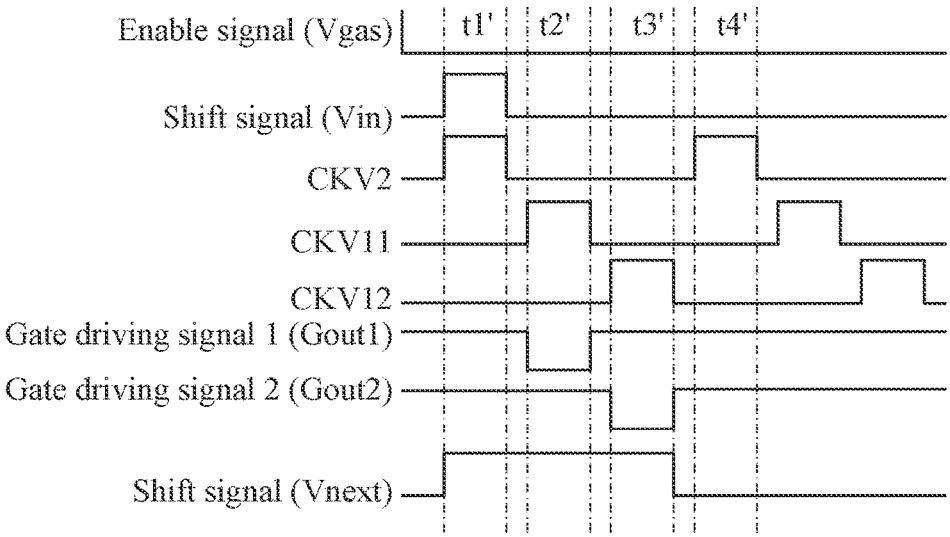
FIG. 11 is a driving timing sequence diagram of the shift register unit corresponding to FIG. 10 provided by an embodiment of the present disclosure.

Exemplarily, FIG. 10 is a structural diagram of a circuit of another shift register unit provided by an embodiment of the present disclosure. FIG. 11 is a driving timing sequence diagram of the shift register unit corresponding to FIG. 10 provided by an embodiment of the present disclosure. The similarities of FIG. 10 and FIG. 11 with FIG. 5 and FIG. 6, can refer to the preceding description of FIGS. 5 and 6, and are not repeated here. Only the differences between FIG. 10 and FIG. 11, and FIG. 5 and FIG. 6 are exemplarily described here. In conjunction with FIGS. 10 and 11, in the first phase t1', a shift module 10 outputs a high-level shift signal Vnext to the enable modules 21 and 22. In a second phase t2', the shift module 10 continues to output the high-level shift signal Vnext to the enable modules 21 and 22 so that the fifth transistors M25 of the enable modules 21 and 22 are turned on, meanwhile, the enable module 21 is also electrically connected to a first clock signal input end CK11, the enable module 22 is also electrically connected to a second clock signal input end CK12, and a first clock signal input end CK11 receives a high-level first clock control signal CKV11, a first clock signal CK12 receives a low-level first clock control signal CKV12, the fourth transistor M24 of the enable module 21 is turned on while the fourth transistor M24 of the enable module 22 is in an off state, so that the enable module 21 generates a gate driving signal Gout1 and the gate driving signal Gout1 is output through the driving signal output end OUT1, while the enable module 22 does not generate the gate driving signal, and the driving signal output end OUT2 does not output the gate driving signal. In a third phase t3, the shift module 10 continues to output the high-level shift signal Vnext to the enable modules 21 and 22 so that the fifth transistors M25 of the enable modules 21 and 22 are turned on, meanwhile, the first clock signal input end CK11 receives the low-level first clock control signal CKV11, a first clock signal CK12 receives the high-level first clock control signal CKV12, the fourth transistor M24 of the enable module 21 is turned off, and the fourth transistor M24 of the enable module 22 is turned on, so that the enable module 22 generates a gate driving signal Gout2 and the gate driving signal Gout2 is output through the driving signal output end OUT2, and the enable module 21 stops outputting the gate driving signal through the driving signal output end OUT1. In a fourth phase t4', the shift module 10 outputs a low-level shift signal Vnext to the enable modules 21 and 22, the second transistors M22 of the enable modules 21 and 22 are turned on, and the high-level first level signal is transmitted to the driving signal output ends OUT1 and OUT2 through the turned-on first transistor M21 and the turned-on second transistor M22, so that both the driving signal output ends OUT1 and OUT2 output a high-level signal, which is not the gate driving signal Gout1 or Gout2. In this way, through multiple first clock control signals (CKV11, CKV12) received by multiple first clock signal input ends (CK11, CK12), the multiple enable modules (21, 22) of a same shift register unit are controlled to sequentially generate the gate driving signals (Gout1 and Gout2). In this case, the multiple enable modules (21, 22) output the gate driving signals (Gout1 and Gout2) in different phases.

Figure 12:
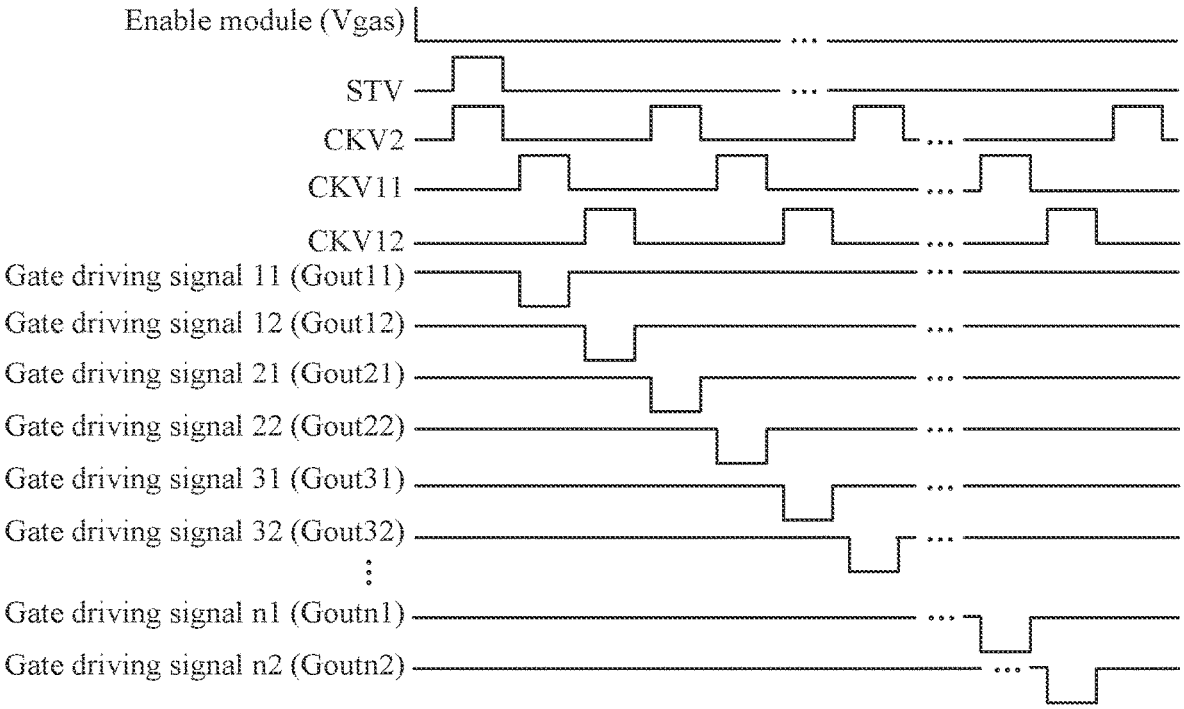
FIG. 12 is a driving timing sequence diagram of another shift register provided by an embodiment of the present disclosure.

FIG. 12 is a driving timing sequence diagram of another shift register provided by an embodiment of the present disclosure. In conjunction with FIGS. 8, 10 and 12, in the case where a shift register unit ASG1 is a first-level shift register unit, a shift signal input end IN of the shift register unit ASG1 receives a high-level initial start signal STV and a second clock signal input end CK2 receives a high-level second clock control signal CKV2, the shift register unit ASG1 outputs the high-level shift signal to a next-level shift register unit ASG2. In a case where the shift signal input end IN of the shift register unit ASG1 receives a low-level initial start signal STV, the second clock signal input end CK2 receives a low-level second clock control signal CKV2, the first clock signal input end CK11 receives the high-level first clock control signal CKV11, and the first clock signal input end CK12 receives the low-level first clock control signal CKV12, the enable module 21 of the shift register unit ASG1 outputs the gate driving signal Gout11. In a case where the shift signal input end IN of the shift register unit ASG1 receives the low-level initial start signal STV, the second clock signal input end CK2 receives the low-level second clock control signal CKV2, the first clock signal input end CK11 receives the low-level first clock control signal CKV11, and the first clock signal input end CK12 receives the high-level first clock control signal CKV12, the enable module 22 of the shift register unit ASG1 outputs the gate driving signal Gout12, meanwhile, other multiple shift register units (ASG2, ASG3, . . . , and ASGn) control the enable modules 21 and the enable modules 22 of the other multiple shift register units to sequentially output the corresponding gate driving signals according to the shift signal output by the previous-level shift register unit received by the shift signal input end IN of the other multiple shift register units themselves, the first clock control signal CKV11 received by the first clock signal input end CK11, the first clock control signal CKV12 received by the first clock signal input end CK12 and the second clock control signal CKV2 received by the second clock signal input end CK2 of the other multiple shift register units themselves, and implementing the sequential shift of the gate driving signals.

Figure 13:
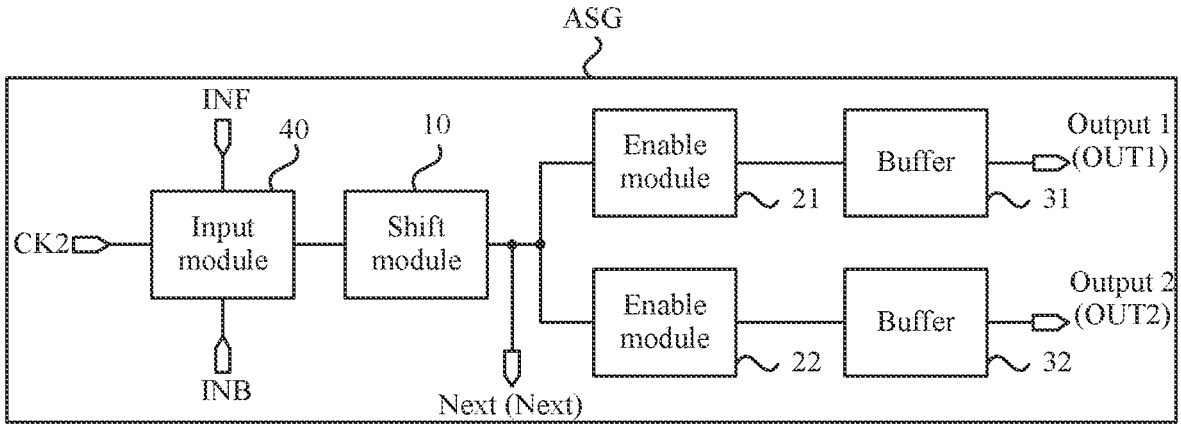
FIG. 13 is a structural diagram of another shift register unit provided by an embodiment of the present disclosure.

In one embodiment, FIG. 13 is a structural diagram of another shift register unit provided by an embodiment of the present disclosure. As shown in FIG. 13, each shift register unit ASG further includes at least two buffers (31, 32) which are in one-to-one correspondence with and electrically connected to at least two enable modules (21, 22), and driving signal output ends (OUT1, OUT2) which are in one-to-one correspondence with and electrically connected to the at least two buffers (31, 32). The buffers (31, 32) can increase the driving capability of the gate driving signals generated by the enable modules (21, 22) and output the gate driving signals through the driving signal output ends (OUT1, OUT2). That is, the buffer 31 can increase the driving capability of the gate driving signal generated by the enable module 21 and output the gate driving signal through the driving signal output end OUT1, and the buffer 32 can increase the driving capability of the gate driving signal generated by the enable module 22 and output the gate driving signal through the driving signal output end OUT2.

Figure 14:
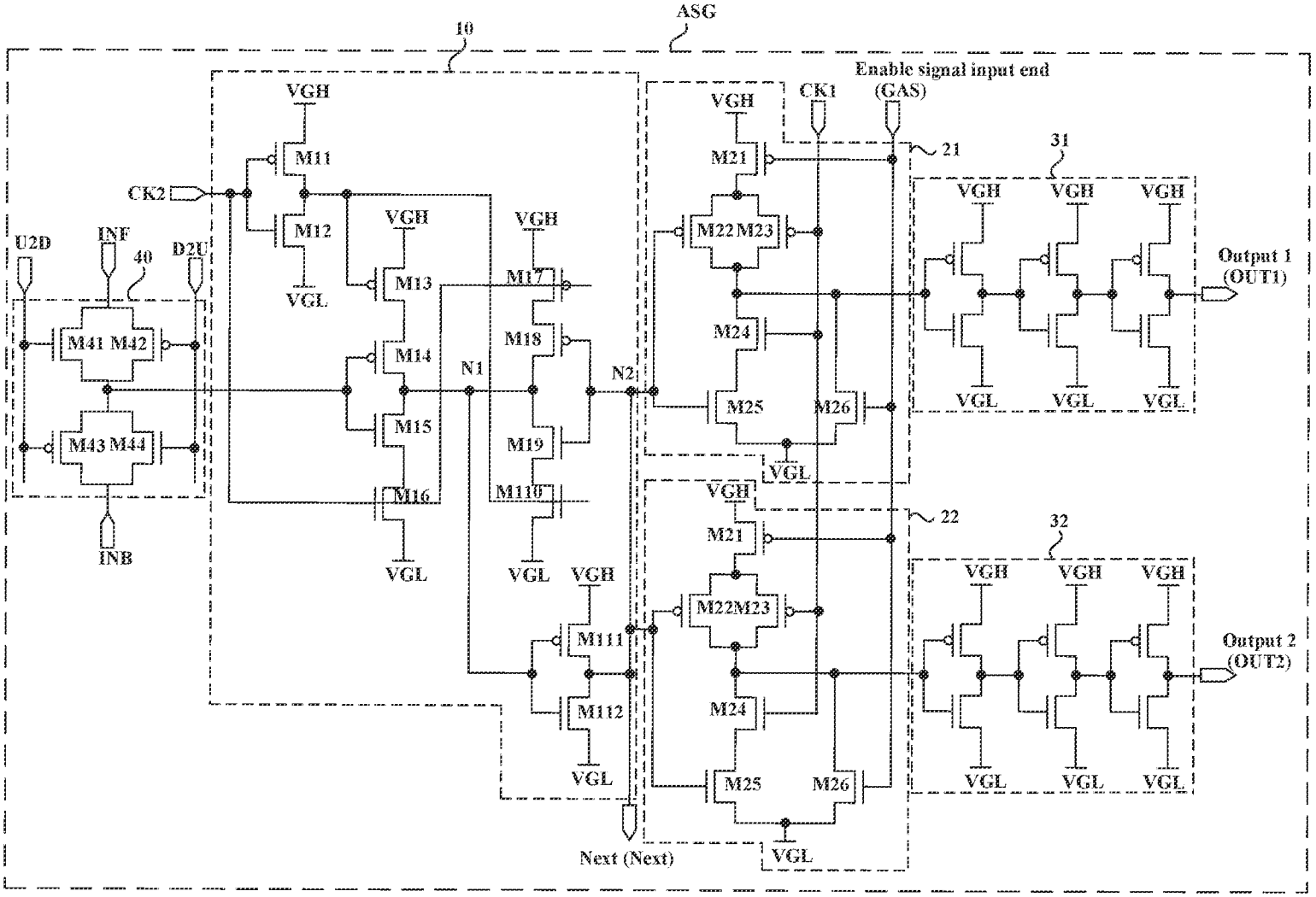
FIG. 14 is a structural diagram of a circuit of another shift register unit provided by an embodiment of the present disclosure.

Exemplarily, FIG. 14 is a structural diagram of a circuit of another shift register unit provided by an embodiment of the present disclosure. As shown in FIG. 14, the multiple buffers (31, 32) of the shift register unit ASG may include three inverters connected in sequence so that a low-level gate driving signal is converted into a high-level gate driving signal after passing through the three inverters connected in sequence; Or in the case where the gate driving signal is a high-level signal, the high-level gate driving signal is converted into the low-level gate driving signal after passing through the three inverters connected in sequence.

In one embodiment, referring to FIG. 13, each shift register unit ASG further includes an input module 40. The input module 40 of the shift register unit ASG is electrically connected to a shift module of a previous-level shift register unit of this shift register unit, a shift module of a next-level shift register unit of this shift register unit, and a shift module of the shift register unit separately. The input module of the shift register unit is configured to input a shift signal output by the shift module of the previous-level shift register unit to the shift module of this shift register unit, or to input a shift signal output by the shift module of the next-level shift register unit to the shift module of the shift register unit.

Exemplarily, the shift register shown in FIG. 1 is used as an example. Referring to FIGS. 1, 8 and 13, the input module of the shift register unit ASG2 is electrically connected to the shift module of the shift register unit ASG1, the shift module of the shift register unit ASG3, and the shift module of the shift register unit ASG2 separately. In this case, the shift register unit ASG2 can output the corresponding shift signal to the shift register unit ASG3 according to the shift signal output by the shift module of the shift register unit ASG1 to implement a forward shift. Alternatively, the shift register unit ASG2 can output the corresponding shift signal to the shift register unit ASG1 according to the shift signal output by the shift module of the shift register unit ASG3 to implement a reverse shift. In this way, by providing the input module 40 in each shift register unit, the shift register 100 can implement the forward shift and the reverse shift, and improving the flexibility of the shift register 100.

In conjunction with FIGS. 13 and 14, each shift register unit may further include a forward shift signal input end U2D and a reverse shift signal input end D2U. The input module 40 may include two transfer gates, a first transfer gate may include transistors M41 and M42, and a second transfer gate may include transistors M43 and M44. The transistors M41 and M43 both are electrically connected to the forward shift signal input end U2D, and the transistors M42 and M44 both are electrically connected to the reverse shift signal input end D2U. And a first electrode of the transistor M41 and a first electrode of the transistor M42 are first transfer gate input ends, and a second electrode of the transistor M41 and a second electrode of the transistor M42 are first transfer gate output ends. A first electrode of the transistor M43 and a first electrode of the transistor M44 are second transfer gate input ends, and a second electrode of the transistor M43 and a second electrode of the transistor M44 are second transfer gate output ends. An input end of the first transfer gate is electrically connected to the shift module of the previous-level shift register unit, an input end of the second transfer gate is electrically connected to the shift module of the next-level shift register unit, and an output end of the first transfer gate and an output end of the second transfer gate are both electrically connected to the shift module of the shift register unit of this level.

The first transfer gate is turned on or off under the control of signals received by the forward shift signal input end U2D and the reverse shift signal input end D2U. And in a case where the first transfer gate is turned on, a signal output by the output end of the first transfer gate is consistent with a signal input by the input end of the first transfer gate. The second transfer gate is turned on or off under the control of signals received by the forward shift signal input end U2D and the reverse shift signal input end D2U. And in a case where the second transfer gate is turned on, a signal output by the output end of the second transfer gate is consistent with a signal input by the input end of the second transfer gate. The first transfer gate and the second transfer gate may adopt any transfer gate structure, which is not repeated here.

The embodiment of the present disclosure also provides a display panel. The display panel includes multiple pixels, multiple scanning line groups and a shift register provided by the embodiment of the present disclosure. Each scanning line group includes at least two scanning signal lines. Each scanning signal line of a same scanning line group is electrically connected to one enable module of a shift register unit in the shift register, and each enable module is electrically connected to at least one scanning line. Multiple pixels are arranged in an array, and the pixels in one row includes at least two pixel groups, and each pixel group includes at least one pixel. The pixels of different pixel groups in a same row are electrically connected to different scanning signal lines of the same scanning line group. The pixels located in the same row and belonging to a same pixel group are electrically connected to a same scanning signal line. A gate driving signal generated by the enable module is provided to the corresponding pixel through the scanning signal line.

In some embodiments, the pixels in the same row in the display panel are divided into at least two pixel groups, multiple pixels of the same pixel group are electrically connected to the same scanning signal line, the pixels of different pixel groups located in the same row are electrically connected to different scanning signal lines of the same scanning line group and to reduce the number of pixels electrically connected to each scanning signal line, and reducing the load amount on each gate driving signal and the delay time of the gate driving signal on each scanning signal line during the transmission process, further reducing the display difference among the multiple pixels in the same row and helping to improve the display uniformity of the display panel. Meanwhile, the display panel provided by the embodiment of the present disclosure includes a shift register provided by the embodiment of the present disclosure, and each shift register unit of the shift register provided by the embodiment of the present disclosure includes at least two enable modules so that at least two gate driving signals can be provided, and multiple scanning signal lines of the same scanning line group are electrically connected to multiple enable modules of the shift register unit, so that the pixels of multiple pixel groups in the same row can receive the corresponding gate driving signals respectively, and improving the driving capability for each pixel, improving the display effect of the display panel, helping to simplify the structure of the shift register and reduce the occupied area of the shift register, further helping to implement the narrow frame of the display panel on the premise of not increasing the number of shift register units in the shift register.

Solutions in embodiments of the present disclosure is described below in conjunction with drawings in the embodiments of the present disclosure.

In the embodiments of the present disclosure, pixels in one row may include at least two pixel groups, that is, the pixels in one row may include two pixel groups, three pixel groups or multiple pixel groups, and the number of scanning signal lines in each scanning line group is same with the number of pixel groups of the pixels in one row, so that multiple scanning signal lines of each scanning line group are electrically connected to the pixels of multiple pixel groups in a same row respectively, that is, one scanning signal line may be electrically connected to multiple pixels in the same row and belonging to the same pixel group, and different scanning signal lines of the same scanning line group are electrically connected to the pixels of different pixel groups in the same row. The number of pixel groups of the pixels in one row and the number of scanning signal lines in one scanning line group are not limited in the embodiments of the present disclosure. Meanwhile, the display panel provided by the embodiments of the present disclosure may be an organic light-emitting display panel, a liquid crystal display panel or other active matrix display panels, that is, each pixel of the display panel includes at least one transistor electrically connected to the scanning signal line, and the at least one transistor is turned on or off under the control of the gate driving signal transmitted by the scanning signal line.

For ease of description, solutions of the embodiments of the present disclosure are exemplarily described by way of an example in which each pixel includes one transistor electrically connected to the scanning signal line.

Each shift register unit of the shift register includes a shift module and at least two enable modules, that is, each shift register unit may include two enable modules, three enable modules or multiple enable modules. The scanning signal lines of the same scanning line group are electrically connected to the enable modules belonging to the same shift register unit, and one enable module is electrically connected to at least one scanning signal line, that is, one enable module may be electrically connected to one scanning signal line, two scanning signal lines or multiple scanning signal lines. Correspondingly, one scanning signal line may be electrically connected to one enable module, two enable modules or multiple enable modules, that is, the number of scanning signal lines may be the same as or different from the number of enable modules, which is not limited in the embodiments of the present disclosure.

In one embodiment, the multiple enable modules of the same shift register unit are in one-to-one correspondence with and electrically connected to multiple scanning signal lines of the same scanning line group, that is, the number of scanning signal lines in the scanning line group is the same as the number of enable modules in the shift register unit. In this case, in a case where the display panel also includes multiple data signal lines, and multiple pixels in the same row are electrically connected to different data signal lines, the multiple enable modules of the same shift register unit may simultaneously generate the gate driving signals to drive multiple pixels in the same row. And in a case where pixels in a same column are electrically connected to a same data signal line, and two adjacent ones of the pixels which are in the same row and are electrically connected to different scanning signal lines share the data signal line, the multiple enable modules of the same shift register unit can sequentially generate the gate driving signals.

Figure 15:
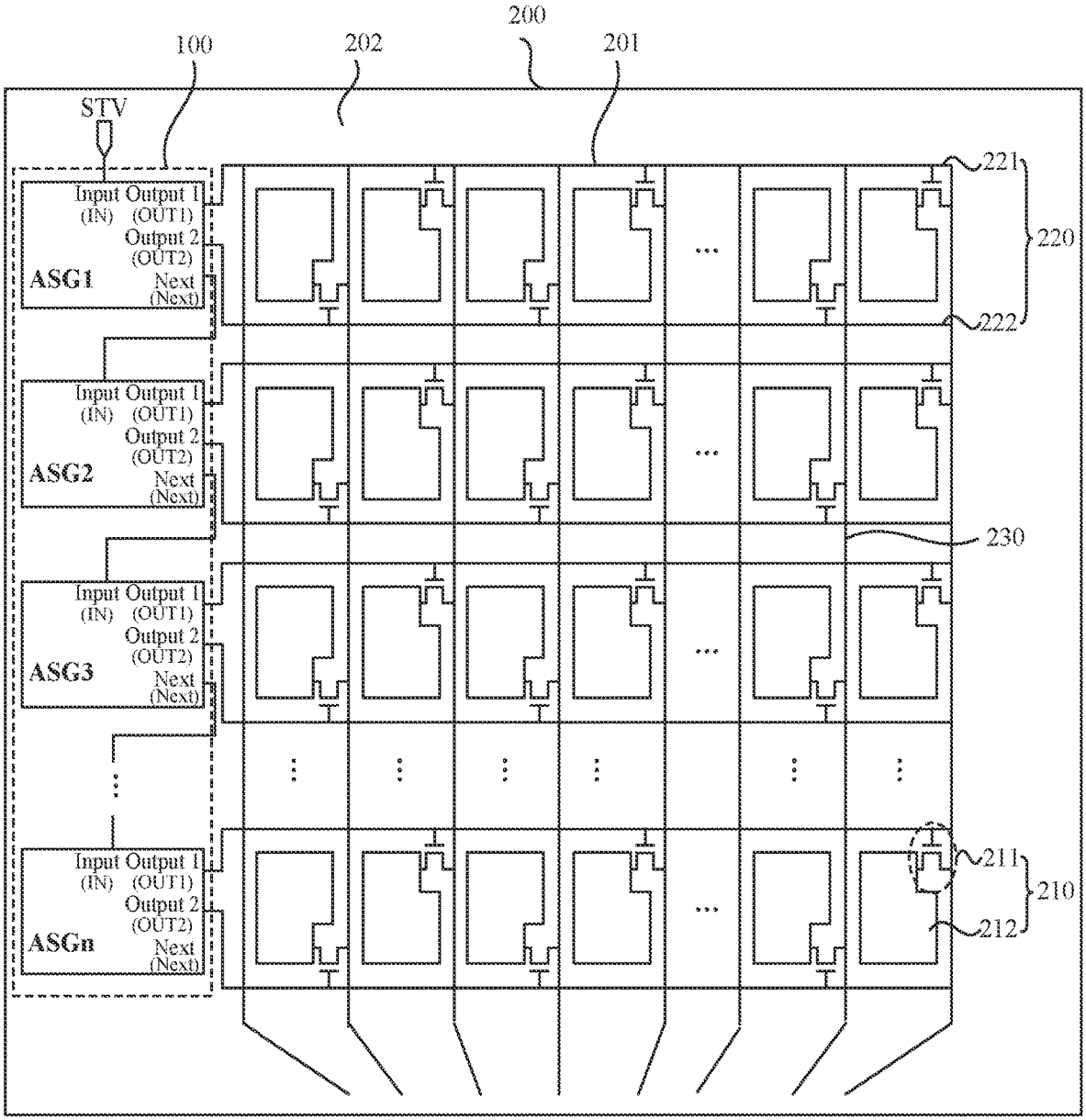
FIG. 15 is a structural diagram of a display panel provided by an embodiment of the present disclosure.

Exemplarily, FIG. 15 is a structural diagram of a display panel provided by an embodiment of the present disclosure. As shown in FIG. 15, the display panel 200 includes a display area 201 and a non-display area 202 surrounding the display area 201. The display area 201 of the display panel 200 is provided with pixels 210 arranged in an array, multiple scanning line groups 220 and multiple data signal lines 230. The pixels 210 in a same column share a same data signal line 230, and the pixels 210 in a same row are electrically connected to different data signal lines 230. Correspondingly, at least two pixel groups of the pixels in one row may include a first pixel group and a second pixel group. The pixels 210 of a first pixel group are located in an odd-number column, and the pixels 210 of a second pixel group are located in an even-number column. Alternatively, the pixels 210 of the first pixel group are located in the even-number column, and the pixels 210 of the second pixel group are located in an odd-number column. In this case, the scanning line group 220 may include a first scanning signal line 221 and a second scanning signal line 222. The pixels 210 in the same row and belonging to the first pixel group are electrically connected to the first scanning signal line 221, and the pixels 210 in the same row and belonging to the second pixel group are electrically connected to the second scanning signal line 222. In a case where each pixel 210 includes a transistor 211 and a display unit 212, and a first electrode of the transistor 211 is electrically connected to the display unit 212, the first scanning signal line 221 may be electrically connected to gates of the transistors 211 in multiple pixels 210 of the first pixel group, and the second scanning signal line 222 may be electrically connected to the gates of the transistors 211 in multiple pixels 210 of the second pixel group. Second electrodes of the transistors 211 in the pixels 210 located in a same column are electrically connected to a same data signal line 230, and the second electrodes of the transistors 211 in the pixels 210 located in the same row are electrically connected to different data signal lines 230. A non-display area 202 of the display panel 200 is provided with a shift register 100. Each shift register unit of the shift register 100 may include two enable modules, and multiple enable modules belonging to a same shift register unit may be in one-to one correspondence with and electrically connected to multiple scanning signal lines (221, 222) of a same scanning line group 220. In this case, the multiple enable modules of the same shift register unit can respectively provide gate driving signals to the multiple scanning signal lines (221, 222) of the same scanning line group 220. For example, the gate driving signal of one enable module of the shift register unit outputs the gate driving signal to the first scanning signal line 221 through a driving signal output end OUT1 of the shift register unit, so that the first scanning signal line 221 transmits the gate driving signal to the gates of the transistors 211 of the multiple pixels 210 in the first pixel group, the transistors 211 of the multiple pixels 210 belonging to the first pixel group in the same row are controlled to be turned on, and a data signal transmitted by the data signal line 230 is able to be written to the display unit 212 electrically connected to the transistor 211 through the turned-on transistors 211, so that the display units of the multiple pixels of the first pixel group display. The gate driving signal of another enable module in the shift register unit outputs the gate driving signal to the second scanning signal line 222 through a driving signal output end OUT2 of the shift register unit, so that the second scanning signal line 222 transmits the gate driving signal to the gates of the transistors 211 of the multiple pixels 210 in the second pixel group, and the transistors 211 of the multiple pixels 210 belonging to the second pixel group in the same row is controlled to be turned on, and the data signal transmitted by the data signal line 230 is able to be written to the display unit 212 electrically connected to the transistor 211 through the turned-on transistors 211, so that the display units of the multiple pixels of the second pixel group display. In this way, since the second electrodes of the transistors 211 in the multiple pixels 210 located in the same row are electrically connected to different data signal lines, Therefore, multiple enable modules of the same shift register unit may output the same gate driving signals, so that the transistors 211 of the multiple pixels 210 located in the same row are turned on at the same time, so that the multiple data signal lines 230 can simultaneously write the data signals respectively transmitted by the multiple data signal lines to the display units 212 of the multiple pixels 210 in the same row.

By using the above embodiments, on the premise of not reducing a data signal write time for the display units of the multiple pixels 210, and not reducing a refresh frequency of the display panel 200, the load amount on the multiple scanning signal lines (221, 222) can be reduced, thus reducing a delay time of the gate driving signal on each scanning signal line during the transmission process, further reducing the display difference among the multiple pixels in the same row, and helping to improve the display uniformity of the display panel.

Figure 16:
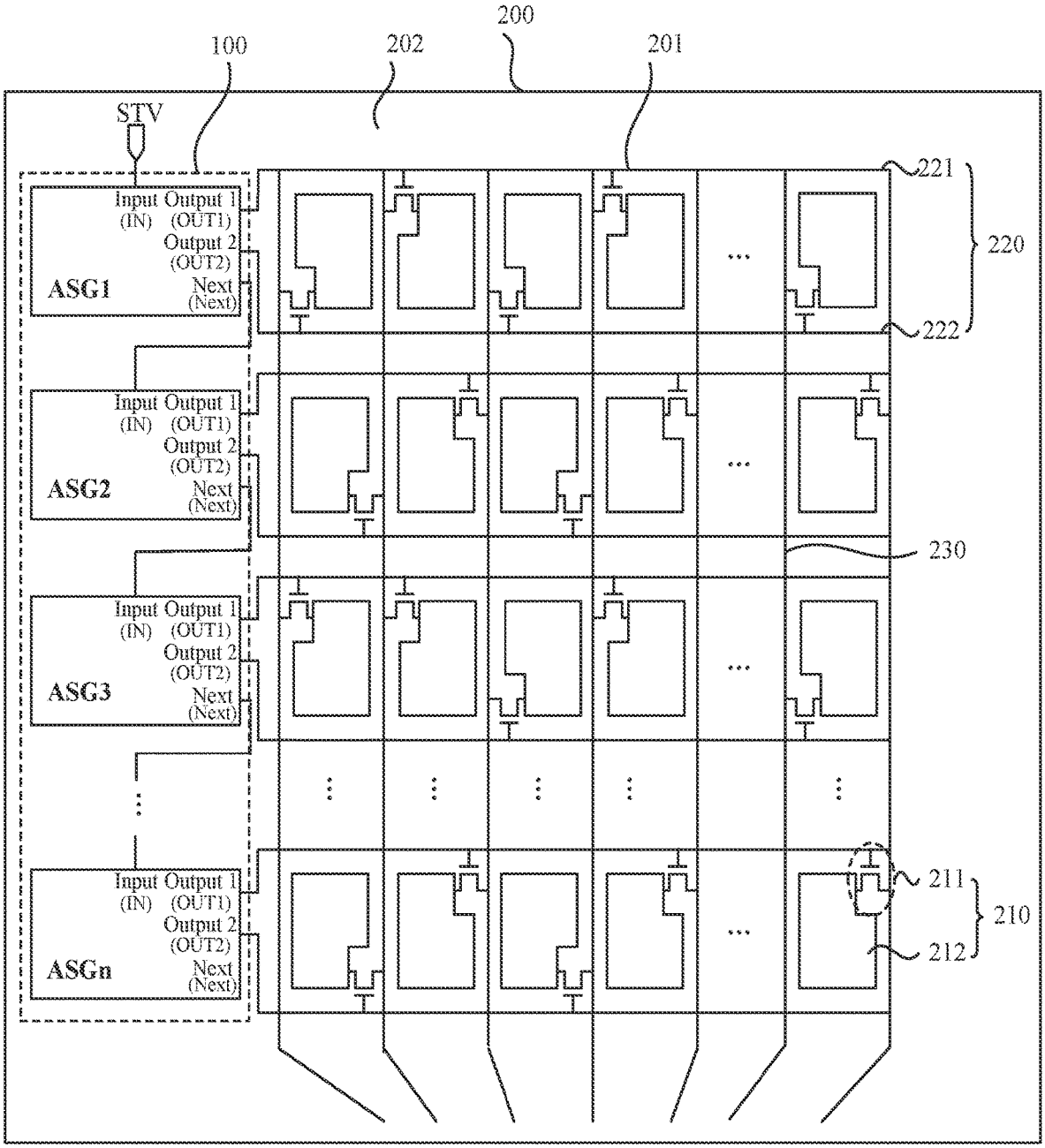
FIG. 16 is a structural diagram of another display panel provided by an embodiment of the present disclosure.

Exemplarily, FIG. 16 is a structural diagram of a display panel provided by an embodiment of the present disclosure. The similarities between FIGS. 16 and 15 can refer to the preceding description of FIG. 15 and are not repeated here. Only the differences between FIGS. 16 and 15 are exemplarily described here. As shown in FIG. 16, two adjacent ones of the pixels 210 in the same column are electrically connected to two adjacent data signal lines 230 respectively, and multiple pixels 210 in the same row are electrically connected to different data signal lines respectively. That is, in two adjacent ones of the pixels in the same column, in a case where the second electrode of the transistor 211 in the pixel 210 in a preceding row is electrically connected to a left data signal line 230 of the pixels in the column, the second electrode of the transistor 211 in the pixel 210 in a subsequent row is electrically connected to a right data signal line 230 of the pixels in the column. In this way, the multiple enable modules of the same shift register unit can simultaneously output gate driving signals, so that the transistors 211 of the multiple pixels 210 located in the same row can be turned on at the same time, so that the multiple data signal lines 230 can simultaneously write the data signals respectively transmitted by the multiple data signal lines 230 to the display units 212 of the multiple pixels 210 in the same row.

Figure 17:
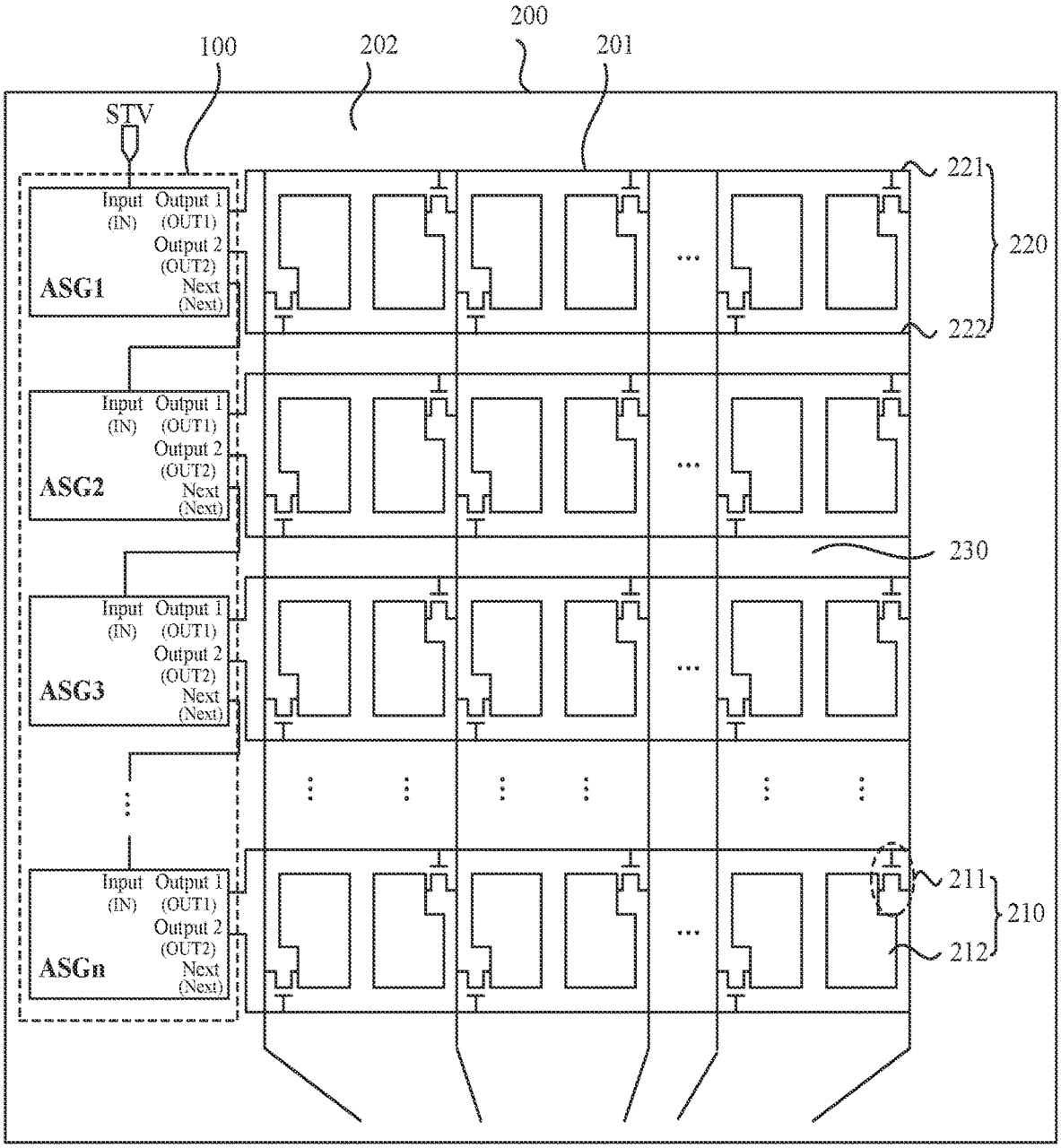
FIG. 17 is a structural diagram of another display panel provided by an embodiment of the present disclosure.

Exemplarily, FIG. 17 is a structural diagram of another display panel provided by an embodiment of the present disclosure. The similarities between FIGS. 17 and 15 can refer to the preceding description of FIG. 15 and are not repeated here. Only the differences between FIGS. 17 and 15 are exemplarily described here. As shown in FIG. 17, pixels in a same column are electrically connected to a same data signal line, and two adjacent ones of the pixels 210 in a same row electrically connected to different scanning signal lines share a data signal line. For example, in a case where gates of transistors 211 in pixels 210 in the same row and in odd-number columns are electrically connected to a second scanning signal line 222, and gates of transistors 211 in pixels 210 in the same row and in even-number columns are electrically connected to a first scanning signal line 221, second electrodes of transistors 211 in two adjacent ones of the pixels in the same row are electrically connected to the same data signal line 230. In this case, multiple enable modules of a same shift register unit are required to sequentially generate gate driving signals. That is, the first scanning signal line 221 transmits the gate driving signals to the gates of the transistors 211 in the pixels 210 in the even-number columns, the transistors 211 in the pixels 210 in the even-number columns are controlled to be turned on, and after a data signal transmitted by the data signal line 230 charges the display units 212 in the pixels in the even-number columns, the second scanning signal line 222 transmits the gate driving signals to the gates of the transistors 211 in the pixels 210 in the odd-number columns, the transistors 211 in the pixels in the odd-number columns are controlled to be turned on until the data signal transmitted by the data signal line 230 charges the display unit 212 in the pixels in the odd-number columns completely. In this way, pixels in two adjacent columns share the data signal line, so that the number of data signal lines in the display area can be reduced, and the aperture opening ratio of the display panel can be improved.

FIGS. 15 to 17 are merely exemplary drawings of the embodiment of the present disclosure. Pixels in one row in FIGS. 15 to 17 include two pixel groups, and the pixels of the two pixel groups are located in the odd-number columns and the even-number columns respectively. In addition, in a case where the pixels in one row include two pixel groups, the two pixel groups may also be located in different display areas, or in a case where the pixels in one row include multiple pixel groups, and the multiple pixel groups may be located in different display areas.

In one embodiment, the display area of the display panel may include at least two sub-display areas. Multiple sub-display areas are sequentially arranged in a row direction. The pixels of the same pixel group are located in a same sub-display area, and the pixels of different pixel groups are located in different sub-display areas.

Figure 18:
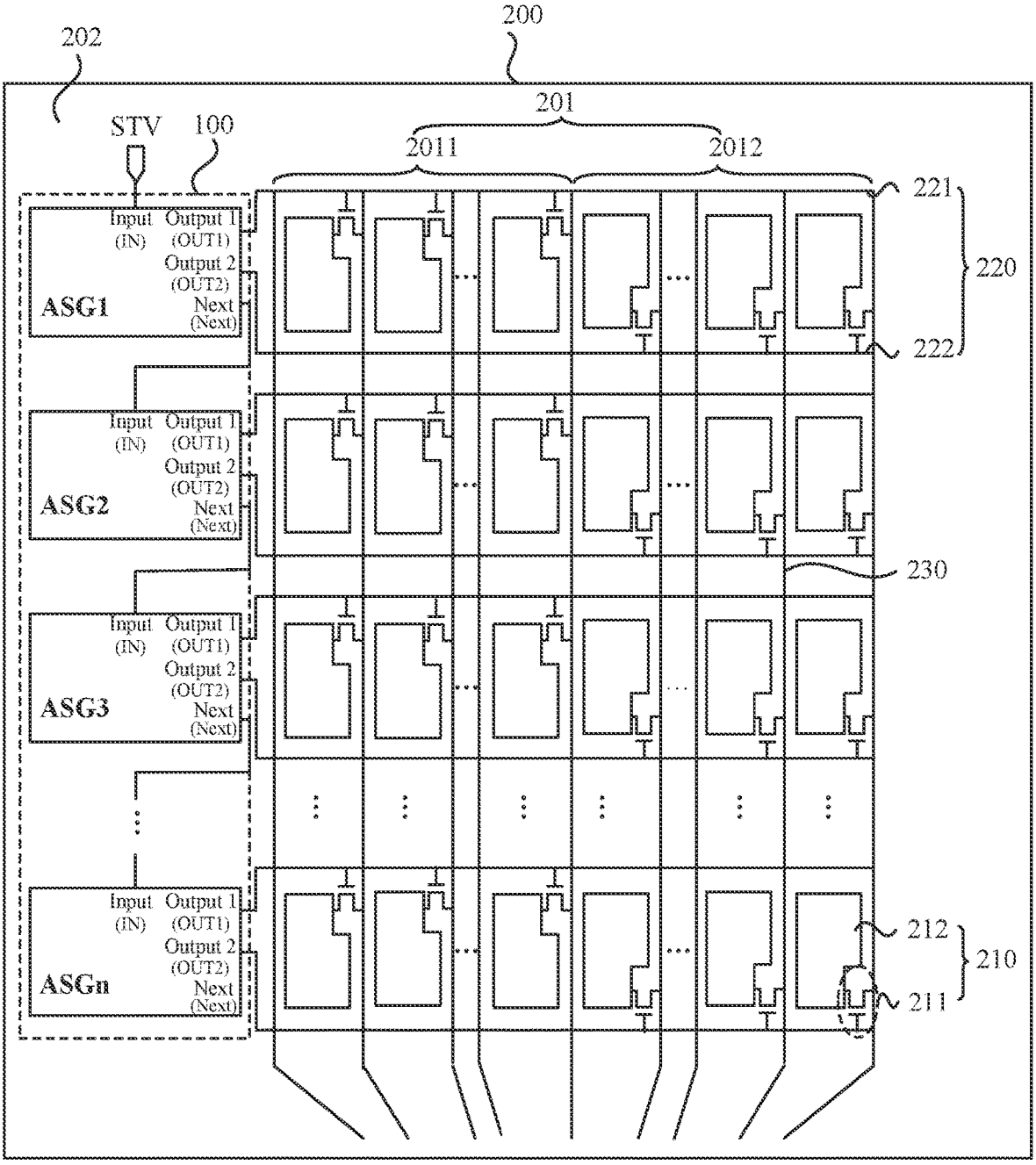
FIG. 18 is a structural diagram of another display panel provided by an embodiment of the present disclosure.

Exemplarily, an extending direction of the scanning signal line is taken as the row direction of the multiple pixels in the display panel, and an extending direction of the data signal line is taken as a column direction of the multiple pixels in the display panel. FIG. 18 is a structural diagram of another display panel provided by an embodiment of the present disclosure. As shown in FIG. 18, a display area 201 of the display panel 200 may include two sub-display areas (2011, 2012). Multiple pixels 210 located in a same row of the sub-display area 2011 are in a same pixel group, and the multiple pixels 210 of the sub-display area 2011 may be electrically connected to a scanning signal line 221. Multiple pixels 210 located in a same row of the sub-display area 2012 are in a same pixel group, and the multiple pixels 210 of the sub-display area 2012 may be electrically connected to a scanning signal line 222. In this way, gate driving signals may be transmitted to multiple pixels in the sub-display area 2011 through the scanning signal line 221, and the gate driving signals may be transmitted to multiple pixels in the sub-display area 2012 through the scanning signal line 222. Compared with the case where the pixels in the same row share one scanning signal line, the number of pixels electrically connected to each scanning signal line can be reduced, so that the load amount on each scanning signal line can be reduced, and reducing the delay time of the gate driving signal on each scanning signal line during the transmission process, further reducing the display difference among multiple pixels in the same row, and helping to improve the display uniformity of the display panel.

FIGS. 15 to 18 are merely exemplary drawings of the embodiment of the present disclosure, and the number of scanning signal lines in the scanning line group in FIGS. 15 to 17 is same with the number of enable modules in the shift register unit; in the embodiment of the present disclosure, the number of scanning signal lines in the scanning line group may be different from the number of enable modules in the shift register unit. In FIG. 18, the display area 201 includes two sub-display areas, which is taken as an example. In the embodiment of the present disclosure, the display area 201 may include two, three or more sub-display areas which are arranged in sequence along a row direction, the number of the sub-display areas is not limited in the embodiment of the present disclosure. Meanwhile, in the embodiment of the present disclosure, " . . . " in the drawings refers to the omitted pixels, scanning signal lines, data signal lines and shift register units. In this case, the number of pixels in each sub-display area may be the same or different, which is not limited by the embodiment of the present disclosure.

In one embodiment, each scanning line group may include at least three scanning signal lines; and at least one of the at least two enable modules in each shift register unit is electrically connected to at least two scanning signal lines. In this case, the number of scanning line groups and the number of enable modules in the shift register unit are not in one-to-one correspondence.

Figure 19:
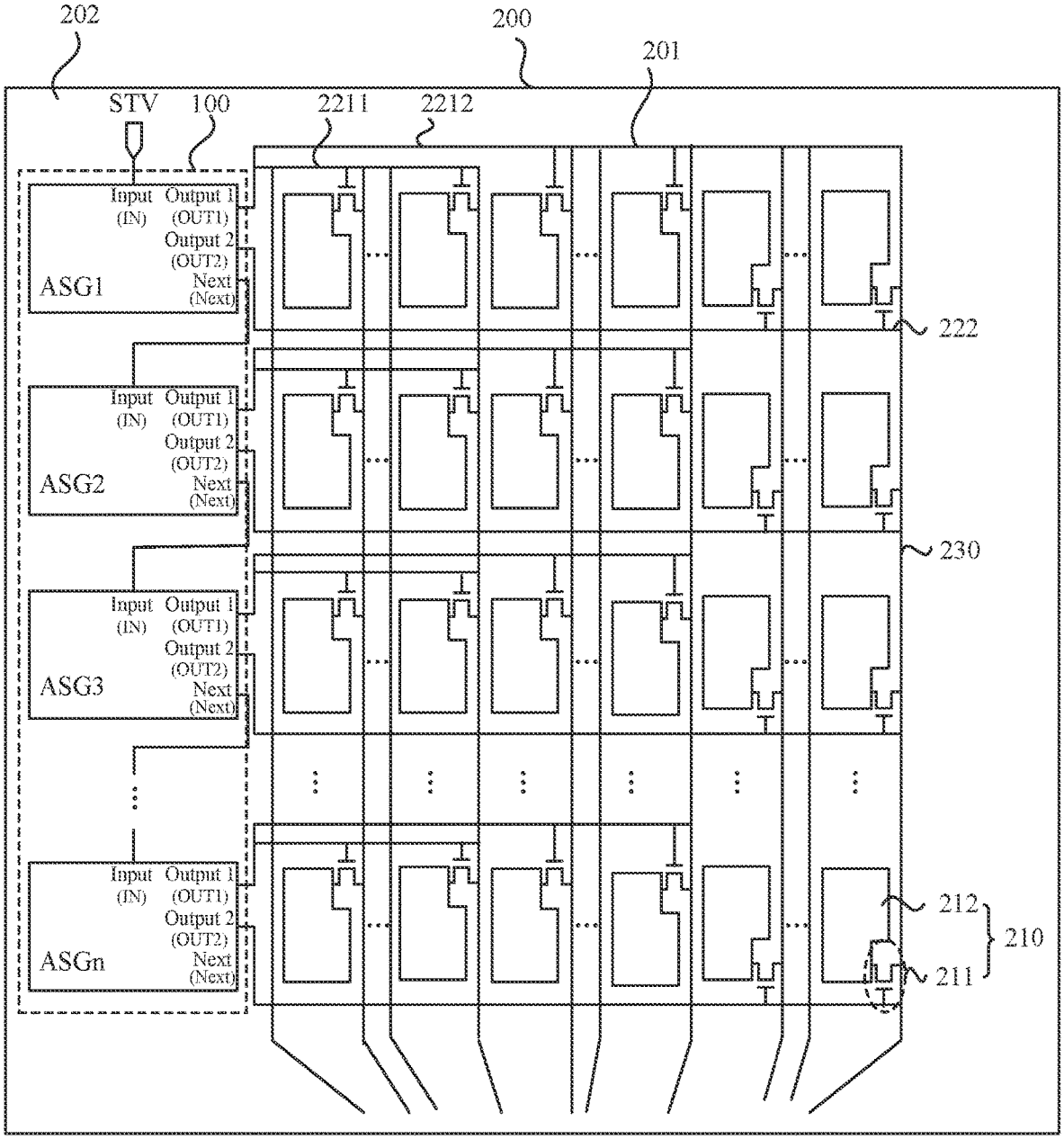
FIG. 19 is a structural diagram of another display panel provided by an embodiment of the present disclosure.

Exemplarily, FIG. 19 is a structural diagram of another display panel provided by an embodiment of the present disclosure. As shown in FIG. 19, pixels in one row of the display panel 200 may include three pixel groups, and one scanning line group may include three scanning signal lines, that is, one scanning line group may include scanning signal lines 2211, 2212 and 222. Each shift register unit may include two enable modules, and gate driving signals generated by the two enable modules are respectively output through driving signal output ends OUT1 and OUT2. In this case, the scanning signal lines 2211 and 2212 may be electrically connected to a same enable module in the shift register unit through the driving signal output end OUT1, and the gate driving signal generated by the enable module is transmitted to the corresponding pixel. The scanning signal line 222 is electrically connected to another enable module in the shift register unit through the driving signal output end OUT2, and the gate driving signal generated by the another enable module is transmitted to the corresponding pixel. In this way, the number of pixels electrically connected to each scanning signal line can be reduced, and helping to reduce the delay time of the gate driving signal on each scanning signal line during the transmission process, and reducing the display difference among multiple pixels in the same row, and helping to improve the display uniformity of the display panel.

In the embodiment of the present disclosure, the shift register of the display panel may further include a first shift register and a second shift register, and the first shift register and the second shift register may be respectively located on two opposite sides of the display area of the display panel.

In one embodiment, the pixels arranged in multiple arrays in the display panel are located in the display area of the display panel. The shift register includes the first shift register and the second shift register. The first shift register and the second shift register are located on two opposite sides of the display area. A scanning line group electrically connected to the pixels in odd-number rows is a first scanning line group, and a scanning line group electrically connected to the pixels in even-number rows is a second scanning line group. The enable module of each level shift register unit of the first shift register is electrically connected to one scanning signal line of the first scanning line group. The enable module of each level shift register unit of the second shift register is electrically connected to one scanning signal lines of the second scanning line group.

Figure 20:
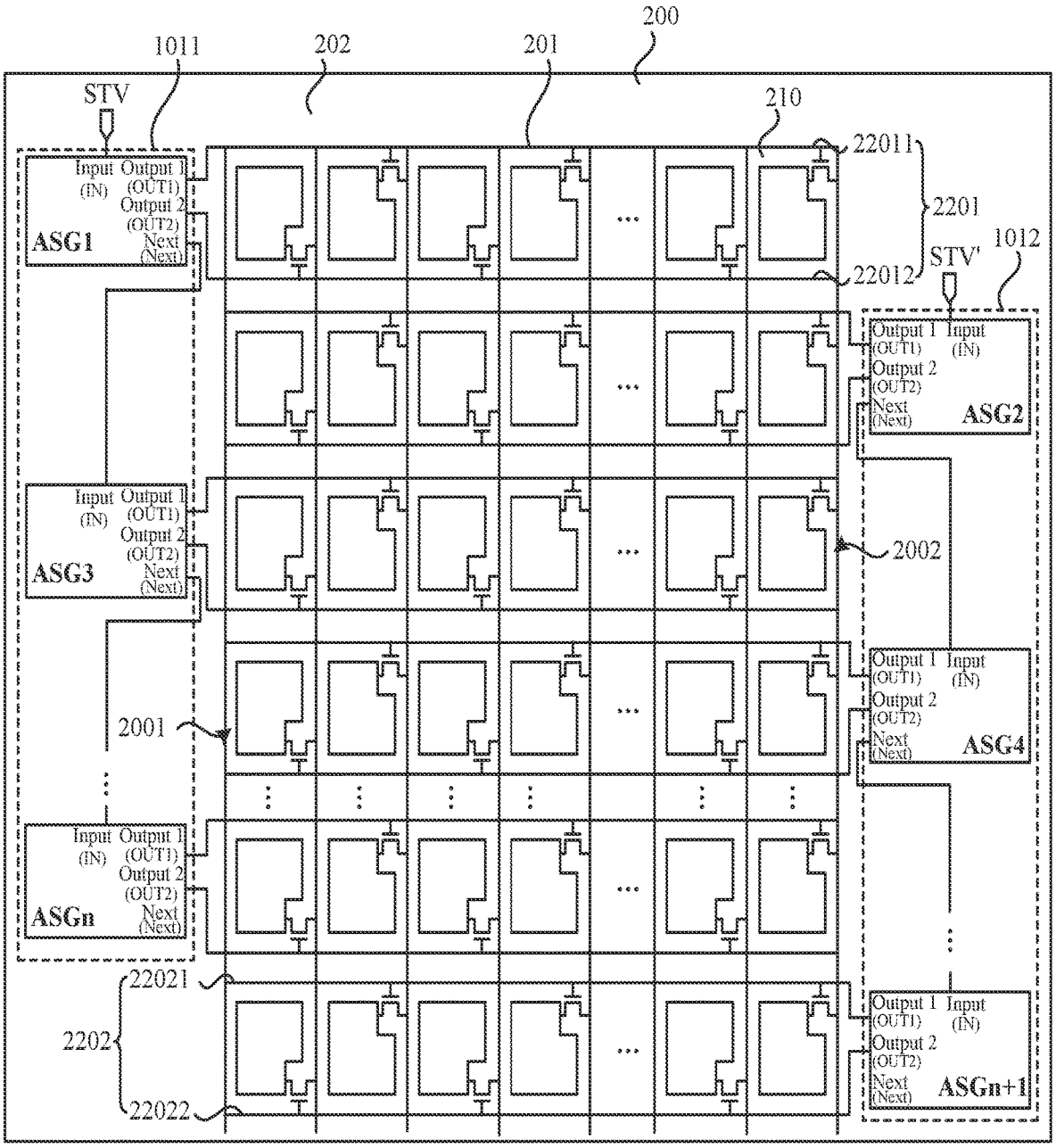
FIG. 20 is a structural diagram of another display panel provided by an embodiment of the present disclosure.

Exemplarily, FIG. 20 is a structural diagram of another display panel provided by an embodiment of the present disclosure. As shown in FIG. 20, a first scanning line group 2201 and a second scanning line group 2202 are included in the display panel, and the first scanning line group 2201 may include two scanning signal lines 22011 and 22012, and the second scanning line group 2202 may include two scanning signal lines 22021 and 22022. Multiple scanning signal lines 22011 and 22022 of the first scanning line group 2202 are electrically connected to pixels of multiple pixel groups in odd-number rows respectively, and the multiple scanning signal lines 22021 and 22022 of the second scanning line group 2202 are electrically connected to pixels of multiple pixel groups in even-number rows respectively. Meanwhile, the shift register includes a first shift register 1011 and a second shift register 1012. Multiple shift register units of the first shift register 1011 are electrically connected to multiple scanning signal lines (22011 and 22012) of the first scanning line group 2201, and multiple shift register units of the second shift register 1012 are electrically connected to multiple scanning signal lines (22021 and 22022) of the second scanning line group 2202. In this way, gate driving signals generated by multiple enable modules of the first shift register 1011 may be provided for multiple pixels in the odd-number rows, and the gate driving signals generated by the multiple enable modules of the second shift register 1012 are provided for multiple pixels of the even-number rows so that the gate driving signals can be provided for the pixels in the odd-number rows and the pixels in the even-number rows respectively. In this case, an initial start signal STV received by a first-level shift register unit ASG1 of the first shift register 1011 is different from an initial start signal STV'received by a first level shift register unit ASG2 of the second shift register 1012, so that data signals transmitted by data signal lines received by the pixels in the odd-number rows and the pixels in the even-number rows do not affect each other. Meanwhile, the first shift register 1011 is located on a first side 2001 of the display area and the second shift register 1011 is located on a second side 2002 of the display area, which facilitates the bezel uniformity of the two opposite sides (the first side 2001 and the second side 2002) of the display panel, and helping to improve the overall aesthetics of the display panel and improve the display effect of the display panel.

FIG. 20 merely exemplarily illustrates the embodiment of the present disclosure by taking an example in which pixels in one row includes two pixel groups. In a case where one pixel includes multiple pixel groups, shift registers arranged on two sides of the display panel may also be used for providing the gate driving signals to multiple pixels in the odd-number rows and in the even-number rows respectively, which is not limited by the embodiment of the present disclosure.

In a case where the first shift register and the second shift register of the shift registers are respectively arranged on two sides of the display panel, the shift register units located at a same level in the first shift register and the second shift register may be electrically connected to multiple pixels in a same row.

Figure 21:
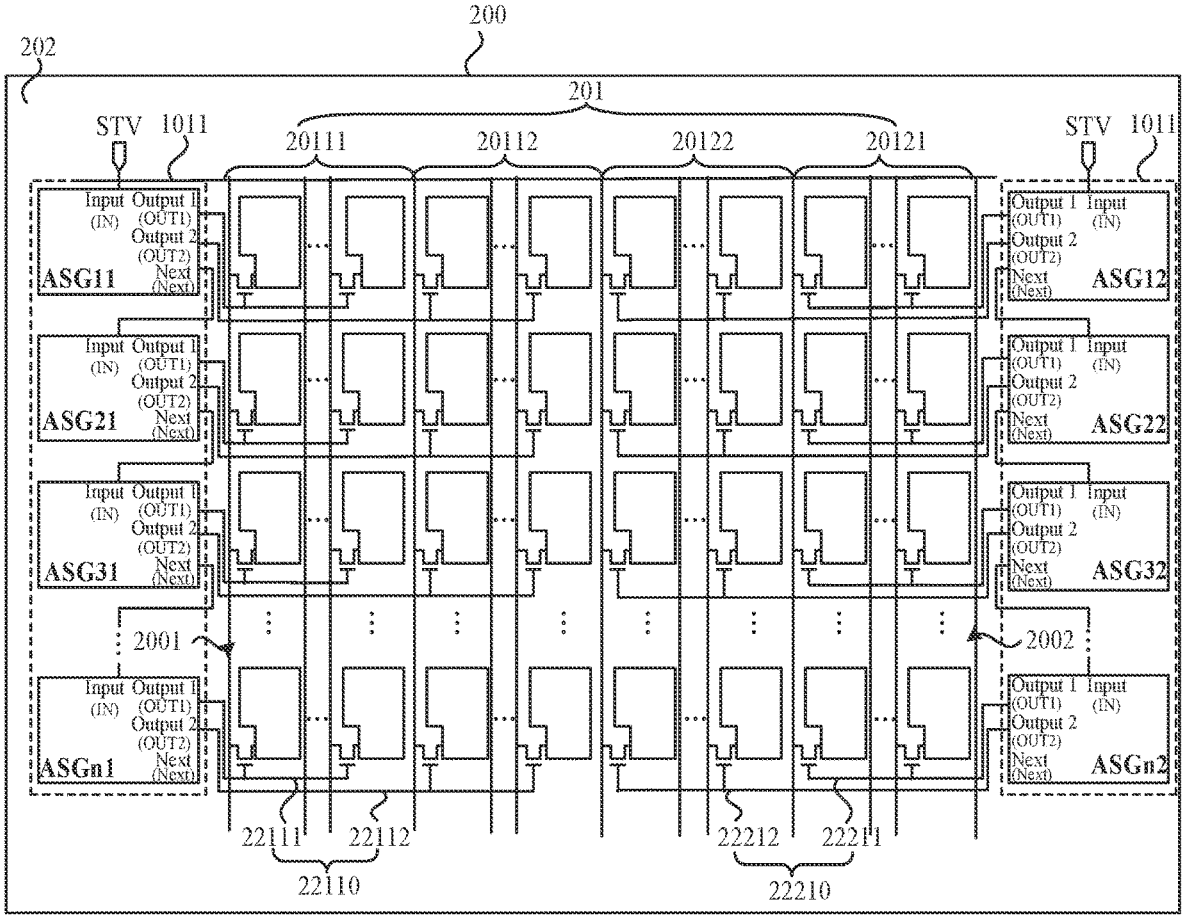
FIG. 21 is a structural diagram of another display panel provided by an embodiment of the present disclosure.

In one embodiment, FIG. 21 is a structural diagram of another display panel according to an embodiment of the present disclosure. As shown in FIG. 21, a display area 201 of a display panel 200 may include N sub-display areas, where N≥4 and N is an integer. Meanwhile, a shift register may include a first shift register 1011 and a second shift register 1012. The first shift register 1011 is located on a first side 2001 of the display area 201, and the second shift register 1012 is located on a second side 2002 of the display area 201. The first side 2001 is opposite to the second side 2002, and a direction from the first side 2001 to the second side 2002 is a row direction of pixels. P sub-display areas (20111, 20112) close to the first side 2001 is a first sub-display area, and Q sub-display area close to the second side 2002 is a second sub-display area (20121, 20122), where P+Q=N, P≥2, Q≥2, and both P and Q are positive integers. Each of the multiple scanning signal lines (22111, 22112) electrically connected to the pixels located in the first sub-display areas (20111, 20112) is a first scanning signal line, and each of the multiple scanning signal lines (22211, 22212) electrically connected to the pixels located in the second sub-display areas (20121, 20122) is a second scanning signal line. Multiple cascaded shift register units of the first shift register 1011 are all first shift register units. Multiple cascaded shift register units of the second shift register 1012 are all second shift register units. Multiple enable modules of the first shift register unit are electrically connected to multiple first scanning signal lines (22111, 22112) respectively. Multiple enable modules of the second shift register unit are electrically connected to the multiple second scanning signal lines (22211, 22212) respectively.

Exemplarily, the display area 201 of the display panel 200 may include four sub-display areas 20111, 20112, 20122 and 20121, two sub-display areas 20111 and 20112 close to the first side 2001 of the display area 201 both are the first sub-display areas, and two sub-display areas 20121 and 20122 close to the second side 2002 of the display area 201 both are the second sub-display areas. Multiple pixels in the first sub-display area 20111 are electrically connected to a first scanning signal line 22111 which receives a gate driving signal generated by one enable module in the shift register unit through a driving signal output end OUT1 of the shift register unit in the first shift register 1011, and the gate driving signal is transmitted to multiple pixels in the first sub-display area 20111. Multiple pixels of the first sub-display area 20112 are electrically connected to a first scanning signal line 22112 which receives the gate driving signal generated by another enable module in the shift register unit through a driving signal output end OUT2 of the shift register unit in the first shift register 1011, and the gate driving signal is transmitted to multiple pixels of the first sub-display area 20112. The multiple pixels of the second sub-display area 20121 are electrically connected to the second scanning signal line 22211 which receives the gate driving signal generated by an enable module in the shift register unit through the driving signal output end OUT1 of the shift register unit in the second shift register 1012 and the gate driving signal is transmitted to the multiple pixels of the second sub-display area 20121. The multiple pixels of the second sub-display area 20122 are electrically connected to the second scanning signal line 22212 which receives the gate driving signal generated by another enable module in the shift register unit through the driving signal output end OUT2 of the shift register unit in the second shift register 1012, and the gate driving signal is transmitted to the multiple pixels of the second sub-display area 20122.

By arranging the first shift register and the second shift register on two opposite sides of the display area, and the enable modules of multiple shift register units in the first shift register can provide the gate driving signal for the multiple pixels close to the first side. The enable modules of multiple shift register units in the second shift register can provide the gate driving signal for the multiple pixels close to the second side to reduce a transmission length of the gate driving signal on the scanning signal line, and reducing the delay time among multiple pixels in the same row, ensuring the charging time of the multiple pixels in the same row to be consistent, and further improving the display uniformity of the display panel.

FIG. 21 is merely an exemplary drawing of an embodiment of the present disclosure. The display area 201 in FIG. 21 includes four sub-display areas, while the display area may include four or more sub-display areas in the embodiment of the present disclosure. In this case, the number P of the first sub-display areas and the number Q of the second sub-display areas may be same or different, which is not limited by the embodiment of the present disclosure.

Figure 22:
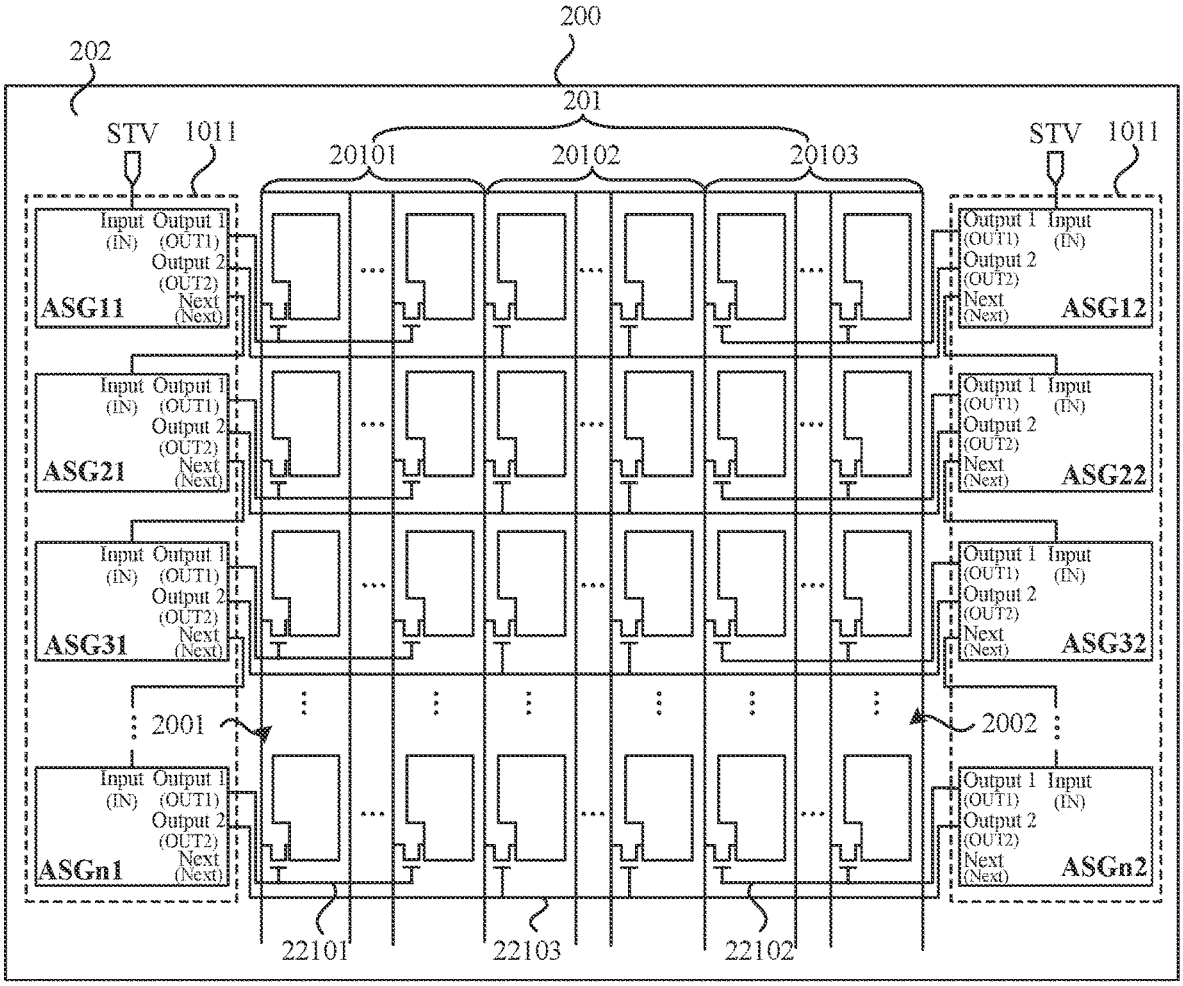
FIG. 22 is a structural diagram of another display panel provided by an embodiment of the present disclosure.

In one embodiment, FIG. 22 is a structural diagram of another display panel provided by an embodiment of the present disclosure. As shown in FIG. 22, a display area 201 of a display panel 200 includes N sub-display areas. N≥3 and N is an integer. The shift register includes a first shift register 1011 and a second shift register 1012; and the first shift register 1011 is located on a first side 2001 of a display area 201, and the second shift register 1012 is located on a second side 2002 of the display area 201. The first side 2001 is opposite to the second side 2002, and a direction from the first side 2001 to the second side 2002 is a row direction of pixels. P sub-display areas (20101) close to the first side 2001 is a first sub-display area, and Q sub-display area (20102) close to the second side is a second sub-display area. M sub-display areas (20103) located between the first sub-display areas (20101) and the second sub-display areas (20102) is a third sub-display area. P+Q+M=N, P, Q and M are all positive integers. Multiple scanning signal lines electrically connected to the pixels located in the first sub-display area (20101) are first scanning signal lines 22101. Multiple scanning signal lines electrically connected to the pixels located in the second sub-display area (20102) are all second scanning signal lines (22102). Multiple scanning signal lines electrically connected to the pixels located in the third sub-display area (20103) are all third scanning signal lines (22103). Multiple cascaded shift register units of the first shift register 1011 are all first shift register units. Multiple cascaded shift register units of the second shift register 1012 are all second shift register units. Multiple enable modules of the first shift register unit are electrically connected to at least one first scanning signal line (22101) and at least one third scanning signal line (22103) respectively. The multiple enable modules of the second shift register unit are electrically connected to at least one second scanning signal line (22102) and at least one third scanning signal line (22103) respectively.

Exemplarily, the display area 201 of the display panel 200 includes three sub-display areas, and one sub-display area 20101 close to the first side 2001 of the display area 201 is the first sub-display area, one sub-display area 20102 close to the second side 2002 of the display area 201 is a second sub-display area, and one sub-display area 20103 located between the first sub-display area 20101 and the second sub-display area 20102 is a third sub-display area. Multiple pixels of the first sub-display area 20101 are electrically connected to the first scanning signal line 22101, and the first scanning signal line 22101 receives the gate driving signal generated by one enable module in the shift register unit through a driving signal output end OUT1 of the shift register unit in the first shift register 1011, and the gate driving signal is transmitted to the multiple pixels of the first sub-display area 20101. Multiple pixels in the second sub-display area 20102 are electrically connected to the second scanning signal line 22102, and the second scanning signal line 22102 receives the gate driving signal generated by one enable module in the shift register unit through the driving signal output end OUT1 of the shift register unit in the second shift register 1012, and the gate driving signal is transmitted to the multiple pixels in the second sub-display area 20102; and multiple pixels of the third sub-display area 20103 are electrically connected to the third scanning signal line 22103. The third scanning signal line 22103 simultaneously transmits the gate driving signal generated by another enable module of the shift register unit in the first shift register 1011 and the gate driving signal generated by another enable module of the shift register unit in the second shift register 1012 to the multiple pixels in the third sub-display area 20103, that is, the third scanning signal line 22103 transmits the gate driving signal output from a driving signal output end OUT2 of the shift register unit in the first shift register 1011 to the multiple pixels in the third sub-display area 20103, and the gate driving signal output from the driving signal output end OUT2 of the shift register unit in the second shift register 1012 is transmitted to the multiple pixels in the third sub-display area 20103.

The pixels of the first sub-display area and the pixels of the second sub-display area located on both sides receive the gate driving signals generated by the enable modules in the first shift register and the second shift register respectively. And the pixels in the third sub-display area which is located in the middle can simultaneously receive the gate driving signals generated by the enable modules in the first shift register and the second shift register, so that the pixels in the third sub-display area which is located in the middle can receive the stronger gate driving signal. But since the pixels of the first sub-display area are closer to the first shift register, the pixels located in the second sub-display area are closer to the second shift register, thus a transmission length of the gate driving signals transmitted to the multiple pixels in the first sub-display area and the multiple pixels in the second sub-display area on the scanning signal line can be shortened, and reducing the delay time among the multiple pixels in one row, and ensuring the charging time of the multiple pixels in the same row to be consistent, and further improving the display uniformity of the display panel.

An embodiment of the present disclosure also provides a display device. The display device includes a display panel provided by the embodiment of the present disclosure, so the display device provided by the embodiment of the present disclosure has beneficial effects of the display panel provided by the embodiment of the present disclosure, which is not be repeated here.

Figure 23:
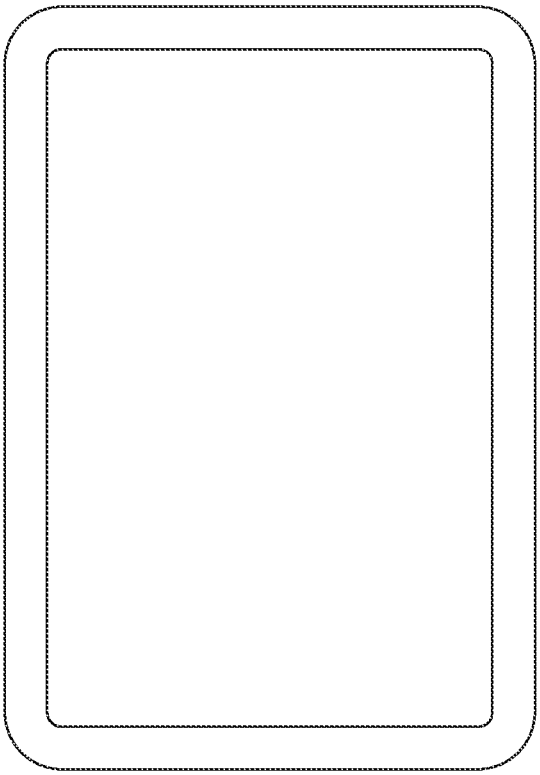
FIG. 23 is a structural diagram of a display device provided by an embodiment of the present disclosure.

Exemplarily, FIG. 23 is a structural diagram of a display device provided by an embodiment of the present disclosure. As shown in FIG. 23, the display device may be, for example, a in-vehicle display screen, a wide-screen mobile phone, a large-screen calculator displayer, and other electronic devices.

What is claimed is:

1. A display panel, comprising:

a plurality of pixels, a plurality of scanning line groups, and a shift register;

wherein the shift register comprises n shift register units which are cascaded; wherein each of the n shift register units comprises a shift module and a plurality of enable modules;

a shift module of an i-th-level shift register unit is configured to receive and latch a shift signal output by a shift module in an (i−1)-th-level shift register unit; and a plurality of enable modules of the i-th-level shift register unit are electrically connected to the shift module of the i-th-level shift register unit, and each of the plurality of enable modules is configured to generate a gate driving signal according to the shift signal;

wherein n and i are positive integers, and $2 \leq i \leq n$;

wherein each of the plurality of the scanning line groups comprises a plurality of scanning signal lines; a plurality of scanning signal lines of one of the plurality of scanning line groups are electrically connected to a plurality of enable modules of a respective one of the n shift register units in the shift register, and each of the plurality of enable modules is electrically connected to at least one of the plurality of scanning signal lines;

the plurality of pixels are arranged in an array; pixels in each row of the array are comprised in a plurality of pixel groups, and each of the plurality of pixel groups comprises at least one of the plurality of pixels;

pixels of different pixel groups in a same row are electrically connected to different scanning signal lines of a same scanning line group, and pixels of each of the plurality of pixel groups are electrically connected to a same scanning signal line; and each of the plurality of enable modules is configured to input a gate driving signal generated by the each of the plurality of enable modules to pixels electrically connected to the at least one of the plurality of scanning signal lines through the at least one of the plurality of scanning signal lines.

2. The display panel of claim 1, wherein each of the n shift register units further comprises:

a first clock signal input end configured to receive a first clock control signal; and in a shift register unit in a same level, two enable modules are electrically connected to a first clock signal input end.

3. The display panel of claim 2, wherein each of the n shift register units further comprises:

a first level signal input end, a second level signal input end, an enable signal input end, and a plurality of driving signal output ends which are in one-to-one correspondence with and electrically connected to the plurality of enable modules;

wherein the first level signal input end is configured to receive a first level signal, the second level signal input end is configured to receive a second level signal, the enable signal input end is configured to receive an enable signal, and each of the plurality of driving signal output ends is configured to output the gate driving signal;

each of the plurality of enable modules comprises a first transistor, a second transistor, a third transistor, a fourth transistor, a fifth transistor, and a sixth transistor;

wherein in one of the plurality of enable modules, a gate of the first transistor is electrically connected to the enable signal input end, a first electrode of the first transistor is electrically connected to the first level signal input end, and a second electrode of the first transistor is electrically connected to a first electrode of the second transistor and a first electrode of the third transistor;

a gate of the second transistor is electrically connected to the shift module, and a gate of the third transistor is electrically connected to a first clock signal input end corresponding to the one of the plurality of enable modules; a second electrode of the second transistor and a second electrode of the third transistor are electrically connected to a driving signal output end corresponding to the one of the plurality of enable modules;

a gate of the fifth transistor is electrically connected to the shift module, a first electrode of the fifth transistor is electrically connected to the second level signal input end, a second electrode of the fifth transistor is electrically connected to a first electrode of the fourth transistor, a second electrode of the fourth transistor is electrically connected to a driving signal output end corresponding to the one of the plurality of enable modules, and a gate of the fourth transistor is electrically connected to a first clock signal input end corresponding to the one of the plurality of enable modules; and a gate of the sixth transistor is electrically connected to the enable signal input end, a first electrode of the sixth transistor is electrically connected to the second level signal input end, and a second electrode of the sixth transistor is electrically connected to the driving signal output end corresponding to the one of the plurality of enable modules;

wherein a channel type of the third transistor is different from a channel type of the fourth transistor, a channel type of the first transistor is different from a channel type of the sixth transistor, and a channel type of the second transistor is different from a channel type of the fifth transistor.

4. The display panel of claim 1, wherein each of the n shift register units further comprises:

a plurality of first clock signal input ends;

in a shift register unit in a same level, first clock control signals received by the plurality of first clock signal input ends are different;

in the shift register unit in the same level, a plurality of enable modules are in one-to-one correspondence with and electrically connected to a plurality of first clock signal input ends; and wherein the plurality of enable modules sequentially generate gate driving signals according to the first clock control signals received by the plurality of first clock signal input ends.

5. The display panel of claim 1, wherein each of the n shift register units further comprises:

a plurality of buffers which are in one-to-one correspondence with and electrically connected to the plurality of enable modules, and a plurality of driving signal output ends which are in one-to-one correspondence with and electrically connected to the plurality of buffers; and each of the plurality of buffers is configured to increase driving capability of a gate driving signal generated by a enable modules corresponding to the each of the plurality of buffers, and output the gate driving signal with increased driving capability through the driving signal output end.

6. The display panel of claim 1, wherein each of the n shift register unit further comprises:

an input module; and an input module of the i-th-level shift register unit is electrically connected to the shift module of the (i−1)-th-level shift register unit, a shift module of the (i+1)-th-level shift register unit and the shift module of the i-th-level shift register unit separately;

the input module is configured to input a shift signal output by the shift module of the (i−1)-th-level shift register unit to the shift module of the i-th-level shift register unit, or is configured to input the shift signal output by the shift module of the (i+1)-th-level shift register unit to the shift module of the i-th-level shift register unit.

7. The display panel of claim 1, further comprising:

a plurality of data signal lines;

wherein pixels in a same column share one of the plurality of data signal lines, and a plurality of pixels in a same row are electrically connected to different data signal lines respectively; or two adjacent pixels in a same column are electrically connected to two adjacent data signal lines respectively, and a plurality of pixels in a same row are electrically connected to different data signal lines respectively.

8. The display panel of claim 1, wherein a plurality of enable modules of a same shift register unit are in correspondence with and electrically connected to a plurality of scanning signal lines of a same scanning line group.

9. The display panel of claim 8, wherein the plurality of enable modules of the same shift register unit sequentially generate gate driving signals; and the display panel further comprises a plurality of data signal lines; the pixels in the same column are electrically connected to a same data signal line; and two adjacent ones of the pixels which are electrically connected to different scanning signal lines respectively share one of the plurality of data signal lines.

10. The display panel of claim 1, wherein each of the plurality of the scanning line groups comprises at least three scanning signal lines; and at least one of the plurality of enable modules of each of the n shift register units is electrically connected to the plurality of scanning signal lines in one of the plurality of scanning line group.

11. The display panel of claim 1, wherein the plurality of pixel groups comprise:

a first pixel group and a second pixel group;

pixels of the first pixel group are located in odd-numbered columns, and pixels of the second pixel group are located in even-numbered columns; or pixels of the first pixel group are located in even-numbered columns, and pixels of the second pixel group are located in odd-numbered columns; and each of the plurality of scanning line groups comprise a first scanning signal line and a second scanning signal line; the pixels of the first pixel group are electrically connected to the first scanning signal line, and the pixels of the second pixel group are electrically connected to the second scanning signal line.

12. The display panel of claim 1, wherein the plurality of pixels and the plurality of scanning line groups are located in a display area of the display panel;

the display area comprises a plurality of sub-display areas; and the plurality of sub-display areas are sequentially arranged in a row direction;

wherein pixels of each of the plurality of pixel groups are located in a same sub-display area, and the pixels of different pixel groups are located in different sub-display areas.

13. The display panel of claim 12, wherein the display area comprises:

N sub-display areas; wherein N≥4, and N is an integer;

the shift register comprises a first shift register and a second shift register; the first shift register is located on a first side of the display area, and the second shift register is located on a second side of the display area; wherein the first side is opposite to the second side, and a direction from the first side to the second side is the row direction of the plurality of pixels;

P sub-display areas close to the first side are first sub-display areas, and Q sub-display areas close to the second side are second sub-display areas; a plurality of scanning signal lines electrically connected to pixels located in the first sub-display area are first scanning signal lines, and a plurality of scanning signal lines electrically connected to pixels located in the second sub-display area are second scanning signal lines; wherein P+Q=N, P≥2, Q≥≥2, and P and Q are both positive integers; and a plurality of shift register units, which are cascaded, of the first shift register are all first shift register units; a plurality of shift register units, which are cascaded, of the second shift register are all second shift register units; a plurality of enable modules of each of the first shift register units are electrically connected to a plurality of first scanning signal lines respectively; and a plurality of enable modules of each of the plurality of second shift register units are electrically connected to a plurality of second scanning signal lines respectively.

14. The display panel of claim 12, wherein the display area comprises N sub-display areas;

wherein N≥3, and N is an integer;

the shift register comprises a first shift register and a second shift register; wherein the first shift register is located on a first side of the display area, and the second shift register is located on a second side of the display area; wherein the first side is opposite to the second side, and a direction from the first side to the second side is the row direction of the plurality of pixels;

P sub-display areas close to the first side are a first sub-display area, and Q sub-display areas close to the second side are a second sub-display area; M sub-display areas located between the first sub-display area and the second sub-display area are a third sub-display area; wherein P+Q+M=N, and P, Q and M are positive integers; and wherein a plurality of scanning signal lines electrically connected to pixels located in the first sub-display area are all first scanning signal lines; a plurality of scanning signal lines electrically connected to pixels located in the second sub-display area are all second scanning signal lines; a plurality of scanning signal lines electrically connected to pixels located in the third sub-display area are all third scanning signal lines; and wherein a plurality of shift register units, which are cascaded, of the first shift register are all first shift register units; a plurality of shift register units, which are cascaded, of the second shift register are all second shift register units; a plurality of enable modules of each of the first shift register units are electrically connected to at least one of the first scanning signal line and at least one of the third scanning signal line respectively; and a plurality of enable modules of each of the second shift register units are electrically connected to at least one of the second scanning signal lines and at least one of the third scanning signal lines respectively.

15. The display panel of claim 1, wherein the plurality of pixels are located in a display area of the display panel;

the shift register comprises a first shift register and a second shift register; the first shift register and the second shift register are located on opposite sides of the display area;

the scanning line groups comprise a first scanning line group electrically connected to the pixels of odd-numbered rows, and a second scanning line group electrically connected to the pixels of even-numbered rows; and wherein a plurality of enable modules of each level of a plurality of shift register units of the first shift register are electrically connected to a plurality of scanning signal lines of one first scan line group; a plurality of enable modules of each level of a plurality of shift register units of the second shift register are electrically connected to a plurality of scanning signal lines of one second scan line group.

16. A display device, comprising:

a display panel, wherein the display panel comprises a plurality of pixels, a plurality of scanning line groups, and a shift register;

wherein the shift register comprises n shift register units which are cascaded; wherein each of the n shift register units comprises a shift module and a plurality of enable modules;

a shift module of an i-th-level shift register unit is configured to receive and latch a shift signal output by a shift module in an (i−1)-th-level shift register unit; and a plurality of enable modules of the i-th-level shift register unit are electrically connected to the shift module of the i-th-level shift register unit, and each of the plurality of enable modules is configured to generate a gate driving signal according to the shift signal;

wherein n and i are positive integers, and 2≤i≤n;

wherein each of the plurality of the scanning line groups comprises a plurality of scanning signal lines; a plurality of scanning signal lines of one of the plurality of scanning line groups are electrically connected to a plurality of enable modules of a respective one of the n shift register units in the shift register, and each of the plurality of enable modules is electrically connected to at least one of the plurality of scanning signal lines;

the plurality of pixels are arranged in an array; pixels in each row of the array are comprised in a plurality of pixel groups, and each of the plurality of pixel groups comprises at least one of the plurality of pixels;

pixels of different pixel groups in a same row are electrically connected to different scanning signal lines of a same scanning line group, and pixels of each of the plurality of pixel groups are electrically connected to a same scanning signal line; and each of the plurality of enable modules is configured to input a gate driving signal generated by the each of the plurality of enable modules to pixels electrically connected to the at least one of the plurality of scanning signal lines through the at least one of the plurality of scanning signal lines.

17. The display device of claim 16, wherein the display panel further comprises:

a plurality of data signal lines;

wherein pixels in a same column share one of the plurality of data signal lines, and a plurality of pixels in a same row are electrically connected to different data signal lines respectively; or two adjacent pixels in a same column are electrically connected to two adjacent data signal lines respectively, and a plurality of pixels in a same row are electrically connected to different data signal lines respectively.

18. The display device of claim 16, wherein a plurality of enable modules of a same shift register unit are in correspondence with and electrically connected to a plurality of scanning signal lines of a same scanning line group.

19. The display device of claim 18, wherein the plurality of enable modules of the same shift register unit sequentially generate gate driving signals; and the display panel further comprises a plurality of data signal lines;

the pixels in the same column are electrically connected to a same data signal line; and two adjacent ones of the pixels which are electrically connected to different scanning signal lines respectively share one of the plurality of data signal lines.

20. The display device of claim 16, wherein each of the plurality of the scanning line groups comprises at least three scanning signal lines; and at least one of the plurality of enable modules of each of the n shift register units is electrically connected to the plurality of scanning signal lines in one of the plurality of scanning line group.

* * * * *